US012800170B2

(12) United States Patent
Benosman et al.

(10) Patent No.: US 12,800,170 B2
(45) Date of Patent: Nov. 17, 2026

(54) REINFORCEMENT LEARNING CONTROL FOR HIGH DIMENSIONAL SYSTEMS MODELED BY PARTIAL DIFFERENTIAL EQUATIONS

(71) Applicant: Mitsubishi Electric Research Laboratories, Inc., Cambridge, MA (US)

(72) Inventors: Mouhacine Benosman, Cambridge, MA (US); Saviz Mowlavi, Somerville, MA (US); Xiangyuan Zhang, Urbana, IL (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 288 days.

(21) Appl. No.: 18/443,374

(22) Filed: Feb. 16, 2024

(65) Prior Publication Data

US 2025/0264237 A1 Aug. 21, 2025

(51) Int. Cl.
*F24F 11/46* (2018.01)
*F24F 11/63* (2018.01)

(52) U.S. Cl.
CPC ..... *F24F 11/46* (2018.01); *F24F 11/63* (2018.01)

(58) Field of Classification Search
CPC ..... F24F 11/46; F24F 11/63; F24F 11/62
See application file for complete search history.

(56) References Cited

U.S. PATENT DOCUMENTS

2016/0223218 A1* 8/2016 Barrett ..... F24F 11/52
2019/0353378 A1* 11/2019 Ramamurti ..... G05B 15/02
(Continued)

OTHER PUBLICATIONS

Zhang, Chi, Yuanyuan Shi, and Yize Chen. "Bear: Physics-principled building environment for control and reinforcement learning." Proceedings of the 14th ACM International Conference on Future Energy Systems. 2023. (Year: 2023).*
(Continued)

*Primary Examiner* — Christopher E. Everett
(74) *Attorney, Agent, or Firm* — Gene Vinokur

(57) ABSTRACT

An optimization controller is provided for controlling an operation of a heating, ventilation and air conditioning (HVAC) system for air-conditioning a room. The controller receives setpoint values, and system measurements and airflow measurements respectively from system sensors arranged in the HVAC system and airflow sensors arranged in the room and performs, by using a memory and a processor, determining a horizon value N based on the setpoints and n parameter values the height dimensional physics-based model based on the system measurements, computing state trajectories corresponding to the parameter values, providing a set of RL controllers represented by first and second gains, the state trajectories, and the reference signals, performing warm-start of the RL policy gradient algorithm using the RL controllers with an initial gain, computing feedback gains, for the set of RL controllers according to the RL policy gradient algorithm, determining optimal feedback gains by averaging the feedback gains, generating a control command based on the optimal feedback gains, and control the operation of the of the HVAC system based on the generated command.

18 Claims, 21 Drawing Sheets

(56) References Cited

U.S. PATENT DOCUMENTS

| | | | | |
|---|---|---|---|---|
| 2021/0190364 | A1* | 6/2021 | Lee | G05B 13/027 |
| 2021/0191342 | A1* | 6/2021 | Lee | F24F 11/62 |
| 2021/0291826 | A1* | 9/2021 | Benosman | B60W 30/16 |
| 2023/0341141 | A1* | 10/2023 | Nabi | F24F 11/63 |

OTHER PUBLICATIONS

Raman, Naren Srivaths, et al. "Reinforcement learning for control of building HVAC systems." 2020 American Control Conference (ACC). IEEE, 2020. (Year: 2020).*

* cited by examiner

Algorithm 1: RHPG

Input: horizon $N$, max iterations $\{T_h\}$, smoothing radius $\{r_h\}$, stepsizes $\{\eta_h\}$ for $h = N-1, \cdots, 0$ do
  Warm start initialization of $K_{h,0}$;
  for $i = 0, \cdots, T_h - 1$ do
    // sample PG update via a zeroth-order oracle
    Sample $K_{h,i}^{+} = K_{h,i} + r_h U$ and $K_{h,i}^{-} = K_{h,i} - r_h U$, where $U$ is uniformly drawn from the surface of a unit sphere, i.e., $\|U\|_F = 1$;
    Sample $x_h \sim \mathcal{D}$ and simulate two trajectories with policies $K_{h,i}^{+}$ and $K_{h,i}^{-}$, respectively. Compute values $J_h(K_{h,i}^{+})$ and $J_h(K_{h,i}^{-})$;
    Compute the estimated PG $\widetilde{\nabla}\mathcal{J}_h(K_{h,i}) = \frac{mn}{2r_h}\left[J_h(K_{h,i}^{+}) - J_h(K_{h,i}^{-})\right]U$
    and update $K_{h,i+1} = K_{h,i} - \eta_h \cdot \widetilde{\nabla}\mathcal{J}_h(K_{h,i})$;
  end
end
Return $K_{0,T_0}$;

FIG. 17C

REINFORCEMENT LEARNING CONTROL FOR HIGH DIMENSIONAL SYSTEMS MODELED BY PARTIAL DIFFERENTIAL EQUATIONS

TECHNICAL FIELD

This invention relates generally to air-conditioning systems, and more particularly to controlling operations of the air-conditioning system.

BACKGROUND

Air-conditioning systems, such as heating, ventilating and air conditioning (HVAC) system, are widely used in industrial and residential applications. For example, the air-conditioning system can include one or a combination of variable speed compressors, variable position valves, and variable speed fans to the vapor compression cycle to deliver particular amount of heat. The command inputs to the vapor compression system that delivers that particular amount of heat are often not unique and the various combinations of components consume different amounts of energy. Therefore, it is desirable to operate the vapor compression system using the combination of inputs that minimizes energy and thereby maximizes efficiency.

Conventionally, methods maximizing the energy efficiency rely on the use of mathematical models of the physics of air-conditioning systems. Those model-based methods attempt to describe the influence of commanded inputs of the components of the vapor compression system on the thermodynamic behavior of the system and the consumed energy. In those methods, models are used to predict the combination of inputs that meets the heat load requirements and minimizes energy.

The operation of a HVAC system changes an airflow in the conditioned environment defining movement of air from one area of the conditioned environment to another. However, the physical model of the airflow is of infinite dimension and is too complex to be used in real time control applications. In addition, the model of the airflow can also change during the operation of the air-conditioning system, see; e.g., U.S. Patent document U.S. 2016/0258644.

To that end, there is a need for a system and a control model generator for controlling air conditioning system using the inputs generated by the control model generator using real time knowledge via sensors of the airflow produced during the operation of the system.

SUMMARY

It is an object of some embodiments to provide a system and a method for controlling an operation of an air-conditioning system in an uncertain environment, such that heat load requirements of the operation are met and a performance of the system is improved. It is a further object of one embodiment to provide such a system and a method that use a model of the airflow in controlling the air-conditioning system. It is a further object of another embodiment to provide such a system and a method that improves the performance of the air-conditioning system over time during the operation of the air-conditioning system.

Some embodiments are based on acknowledgment that the air-conditioning systems vary over time. A model that accurately describes the operation of a vapor compression system at one point in time may not be accurate at a later time as the system changes, for example, due to slowly leaking refrigerant or the accumulation of corrosion on the heat exchangers. In addition, the models of the air-conditioning system often ignore installation-specific characteristics such as room size, causing the model of the air-conditioning system to deviate from operation of the system.

Some embodiments are based on recognition that the knowledge of the airflow produced during an operation of air-conditioning system can be used to optimize the operation of the system. However, the model of the airflow can also change during the operation of the air-conditioning system. Accordingly, there is a need for a system and a method for controlling air-conditioning system using real time knowledge of the airflow produced during the operation of the system.

Unfortunately, the physical model of the airflow is of infinite dimension and too complex to be used in real time control applications. Accordingly, some embodiments use the model of low dimension suitable for real time update and control. For example, in some embodiments the model includes a reduced order model having a number of parameters less than a physical model of the airflow according to a Boussinesq equation, wherein the Boussinesq equation is a partial differential equation (PDE), and wherein the reduced order model is an ordinary differential or difference equation (ODE).

To that end, some embodiments address a model reduction problem aim to reduce a complex model of, e.g., an infinite dimension, to a simpler model of a lesser dimension, e.g., a finite dimension. In this context, the model reduction problem means determining all parameters or coefficients of the simpler model such that an error between performance measurements of the system according to the complex model and the system according to the simpler model is minimized. For example, in air flow modeling estimation and control applications, there is a need to transform the PDE models representing the air flow with ODE models that have lesser dimension and complexity. Such reduction can allow a real-time control of the air flow systems, such as air conditioning systems.

Some embodiments are based on a realization that PDE models have two types of parameters, i.e., internal and external parameters. The internal parameters refer to internal gains of the model that have no meaning outside of the model. The external parameters are physical parameters of the world affecting the airflow and exist independently from the model of the airflow dynamics. Examples of such physical parameters include one or combination of a viscosity of the air in the conditioned environment, geometry of the conditioned environment, number and types of objects in the conditioned environment, e.g., heat sources such as people.

Some embodiments are based on recognition that reduction of the model complexities, e.g., transformation of the PDE model into an ODE model, should preserve the physical parameters of the PDE model in the reduced complexity model. In such a manner, the reduced complexity model can more accurately represent the PDE model. However, the physical parameters of the PDE model are often ambiguous, i.e., include uncertainties. For example, the viscosity of the air and/or different number of people can be present in the conditioned environment at different times. Some embodiments are based on recognition that the values of the physical parameters are uncertain with a bounded uncertainty, referred herein as a range of the bounded uncertainty. However, within the range of the bounded uncertainty, the values of the physical parameters are unknown and can vary.

Some embodiments are based on realization that the lack of knowledge about the physical parameters of the model of airflow dynamics can be compensated by forcing an energy function of an observation error in the conditioned environment to decrease for any value of the physical parameters within a range of the bounded uncertainty. To that end, some embodiments use a Lyapunov approach to analyze the energy function and its derivative with respect to time. Some embodiments are based on realization that such an approach allows to absorb the effect of the uncertainties of the physical parameters on estimation of the state of the airflow.

During the analysis of the derivative of the Lyapunov function some embodiments found a control term that make the derivative of the Lyapunov function always negative, regardless of the actual value of the uncertainties. This term includes a product of a range of the bounded uncertainty and a negative gain to make the derivative of the Lyapunov function always negative, regardless of the actual value of the uncertainties, which in turn, makes the energy function decreases over time iterations, regardless of the value of the uncertainties, and thus the full observation error decreases to zero over the time iterations, for any value of the physical parameters within a range of the bounded uncertainty.

Some embodiments modify the model of airflow dynamic with that control term that relates the range of bounded uncertainty of the physical parameter with a derivative of the energy function. To that end, in some embodiments, the model of airflow dynamics includes a first control term transitioning the previous state of the airflow to the current state of the airflow to reduce a partial observation error for the set of points in the conditioned environment and a second control term including a product of the range of the bounded uncertainty and a negative gain to reduce an energy function of a full observation error for all points in the conditioned environment for any value of the physical parameter within the range of the bounded uncertainty.

In some implementations, the second control term includes the range of the bounded uncertainty multiplied by the negative gain, the measurements, and the partial observation error for the set of points in the conditioned environment. Such a virtual control term forces the derivative of energy function to be negative definite for all points in the conditioned environment. In some embodiments, the energy function is a Lyapunov function of an integral of a squared difference between the true state of the airflow and the state of the airflow estimated by the embodiments.

In some embodiments, the obtained reduced order model consisting of the first and second terms is used to design a model-based controller, which is then used as a warm start for an online learning controller which learns the optimal policies to control the HVAC system from data measurements.

In some embodiments, the learning controller is based on a reinforcement learning gradient policy iteration algorithm, which learns the optimal control policy online, starting from the warm start obtained by the model-based controller.

In some embodiments, the learning controller is based on a reinforcement learning gradient policy iteration algorithm, which learns the optimal control policy offline, based on a measurement obtained from a high-fidelity simulator, starting from the warm start obtained by the model-based controller.

In some embodiments, we consider uncertainties in the high-fidelity simulator, and the learning controller is based on a reinforcement learning gradient policy iteration algorithm, which learns the optimal control policy offline, based on a measurement obtained from a set of different executions of the high-fidelity simulator, starting from the warm start obtained by the model-based controller. In such embodiments, the set of executions of the high-fidelity simulator is obtained by randomly sampling an uncertain variable in the high-fidelity simulator, to cover a wider range of high-fidelity simulator executions.

Further, some embodiments provide a non-transitory computer-readable medium having stored thereon a set of instructions for controlling an electric motor, which if performed by one or more processors, cause the one or more processors to at least: determine a horizon value based on the setpoints and n parameter values of the HD physics-based model based on the system measurements; compute state trajectories corresponding to the parameter values;

provide a set of RL controllers represented by first and second gains, the state trajectories, and the reference signals; perform warm-start of the RL policy gradient algorithm using the RL controllers with an initial gain; compute feedback gains, for the set of RL controllers, according to the RL policy gradient algorithm; determine optimal feedback gains by averaging the feedback gains; generate a control command based on the optimal feedback gains; and transmit the control command to a supervisory controller connected to a set of control devices of the HVAC system to control the operation of the of the HVAC system.

Accordingly, one embodiment discloses a system for controlling an operation of an air-conditioning system generating airflow in a conditioned environment. The system includes a set of sensors to produce measurements of the airflow in a set of points in the conditioned environment; an observer including a processor to determine a current state of the airflow in the conditioned environment using the measurements and a model of airflow dynamics connecting a previous state of the airflow in the conditioned environment with the current state of the airflow in the conditioned environment, wherein the model of airflow dynamics has physical parameters of the conditioned environment, wherein a value of at least one physical parameter is uncertain with a bounded uncertainty defining a range of the bounded uncertainty, wherein the model of airflow dynamics includes a first control term transitioning the previous state of the airflow to the current state of the airflow to reduce a partial observation error for the set of points in the conditioned environment and a second control term including a product of the range of the bounded uncertainty and a negative gain to reduce an energy function of a full observation error for all points in the conditioned environment for any value of the physical parameter within the range of the bounded uncertainty; and a controller to control the air-conditioning system based on the current state of the airflow.

BRIEF DESCRIPTION OF THE DRAWINGS

The accompanying drawings, which are included to provide a further understanding of the invention, illustrate embodiments of the invention and together with the description to explain the principle of the invention. The drawings shown are not necessarily to scale, with emphasis instead generally being placed upon illustrating the principles of the presently disclosed embodiments.

FIG. 17C is a Meta-code of policy gradient RL algorithm for high dimensional system.

Figure 1A:
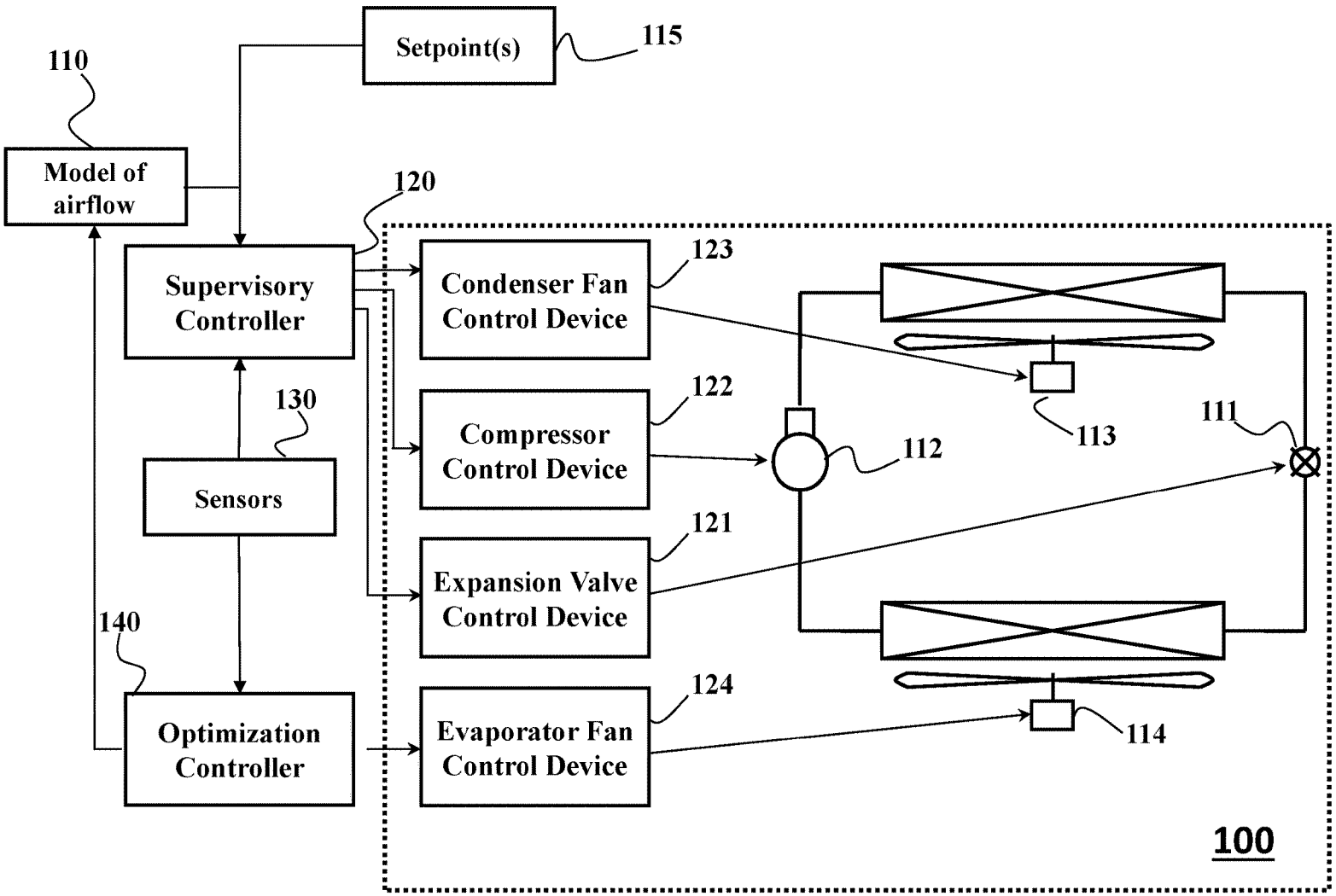
FIG. 1A is a block diagram of an air-conditioning system according to one embodiment of the invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

In describing embodiments of the invention, the following definitions are applicable throughout (including above).

A "control system" or a "controller" refers to a device or a set of devices to manage, command, direct or regulate the behavior of other devices or systems. The control system can be implemented by either software or hardware and can include one or several modules. The control system, including feedback loops, can be implemented using a microprocessor. The control system can be an embedded system.

An "air-conditioning system" or a heating, ventilating, and air-conditioning (HVAC) system refers to a system that uses the vapor compression cycle to move refrigerant through components of the system based on principles of thermodynamics, fluid mechanics, and/or heat transfer. The air-conditioning systems span a very broad set of systems, ranging from systems which supply only outdoor air to the occupants of a building, to systems which only control the temperature of a building, to systems which control the temperature and humidity.

"Components of an air-conditioning system" refer to any components of the system having an operation controllable by the control systems. The components include, but are not limited to, a compressor having a variable speed for compressing and pumping the refrigerant through the system; an expansion valve for providing an adjustable pressure drop between the high-pressure and the low-pressure portions of the system, and an evaporating heat exchanger and a condensing heat exchanger, each of which incorporates a variable speed fan for adjusting the air-flow rate through the heat exchanger.

An "evaporator" refers to a heat exchanger in the vapor compression system in which the refrigerant passing through the heat exchanger evaporates over the length of the heat exchanger, so that the specific enthalpy of the refrigerant at the outlet of the heat exchanger is higher than the specific enthalpy of the refrigerant at the inlet of the heat exchanger, and the refrigerant generally changes from a liquid to a gas. There may be one or more evaporators in the air-conditioning system.

A "condenser" refers to a heat exchanger in the vapor compression system in which the refrigerant passing through the heat exchanger condenses over the length of the heat exchanger, so that the specific enthalpy of the refrigerant at the outlet of the heat exchanger is lower than the specific enthalpy of the refrigerant at the inlet of the heat exchanger, and the refrigerant generally changes from a gas to a liquid. There may be one or more condensers in the air-conditioning system.

"Set of control signals" refers to specific values of the inputs for controlling the operation of the components of the vapor compression system. The set of control signals includes, but are not limited to, values of the speed of the compressor, the position of the expansion valve, the speed of the fan in the evaporator, and the speed of the fan in the condenser.

A "set-point" refers to a target value the system, such as the air-conditioning system, aim to reach and maintain as a result of the operation. The term setpoint is applied to any particular value of a specific set of control signals and thermodynamic and environmental parameters.

A "central processing unit (CPU)" or a "processor" refers to a computer or a component of a computer that reads and executes software instructions.

A "module" or a "unit" refers to a basic component in a computer that performs a task or part of a task. It can be implemented by either software or hardware.

FIG. 1A shows a block diagram of an air-conditioning system 100 according to one embodiment of the invention. The system 100 can include one or a combination of components such an evaporator fan 114, a condenser fan 113, an expansion valve 111, and a compressor 112. The system can be controlled by a controller 120 responsible for accepting setpoints 115, e.g., from a thermostat, and readings of a sensor 130, and outputting a set of control signals for controlling operation of the components. A supervisory controller 120 is operatively connected to a set of control devices for transforming the set of control signals into a set of specific control inputs for corresponding components. For example, the supervisory controller is connected to a compressor control device 122, to an expansion valve control device 121, to an evaporator fan control device 124, and to a condenser fan control device 123.

The supervisory controller is operatively connected to a model of the airflow dynamics 110 connecting values of flow and temperature of air conditioned during the operation of the air-conditioning system. In this manner, the supervisory controller controls operation of the air-conditioning system such that the set-point values are achieved for a given heat load. For example, the supervisory controller determines and/or updates at least one control input for at least one component of the air-conditioning system to optimize a metric of performance determines using the model. Other configurations of the system 100 are possible.

The system 100 is also controlled by an optimization controller 140 for updating parameters of the model of the airflow dynamics. In some embodiments, the optimization controller 140 updates the model 140 iteratively, e.g., for each or some steps of control, to reduce an error between values of the airflow determined according to the model and values of the airflow measured by the sensors 130 during the operation of the system 100.

In various embodiments the supervisory and optimization controller are implemented as a single or separate systems and generally referred herein as a controller. The controller can include a memory storing the model 110, and a processor for controlling the operation of the system 100 and for updating the model during the operation.

Figure 1B:
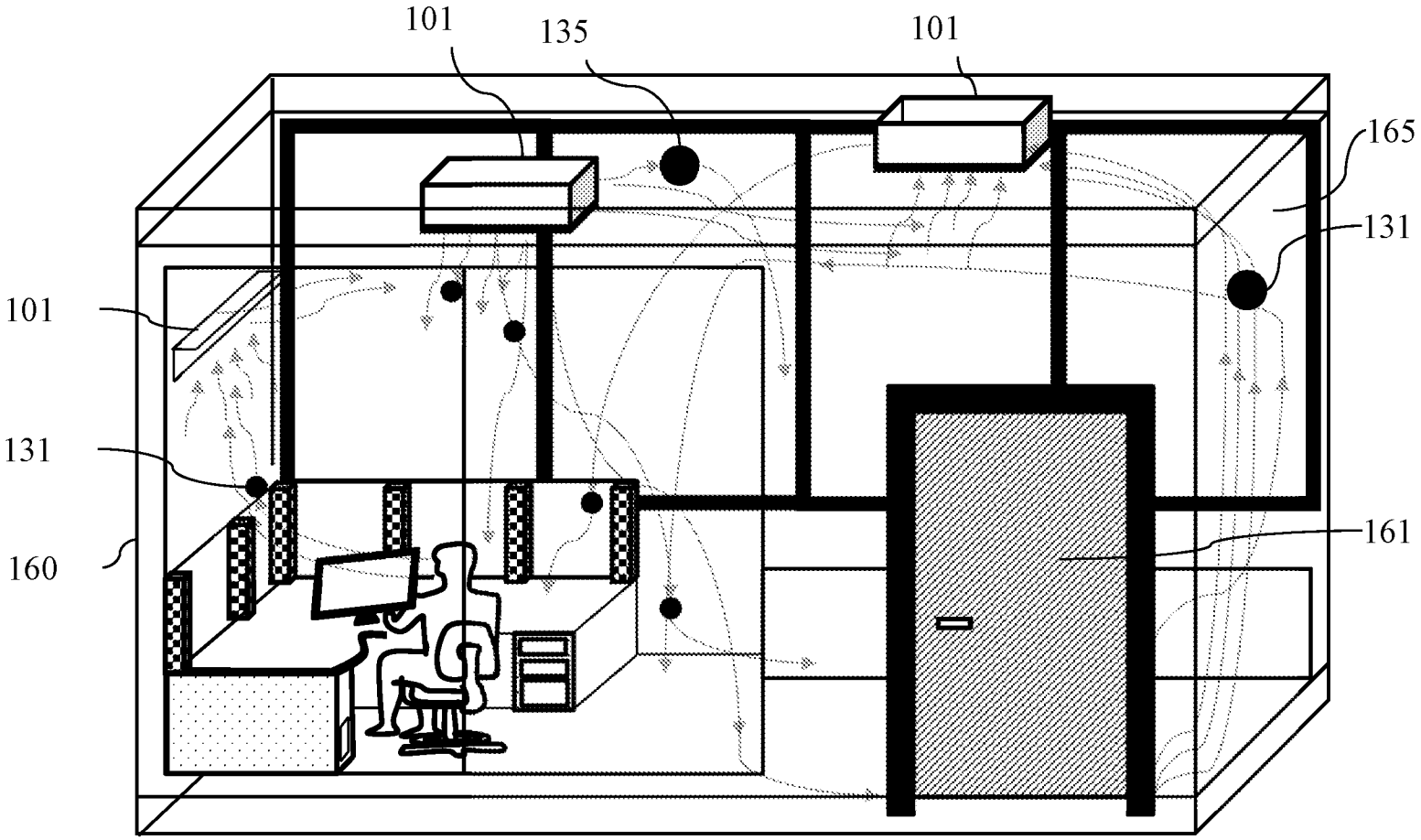
FIG. 1B is a schematic of an example of air-conditioning a room according to some embodiments of the invention.

FIG. 1B shows a schematic of an example of air-conditioning a room 160 according to some embodiments of the invention. In this example, the room 160 has a door 161 and at least one window 165. The temperature and airflow of the room is controlled by the air-conditioning system, such as the system 100 through ventilation units 101. A set of sensors 130 is arranged in the room, such as at least one airflow sensor 131 for measuring velocity of the air flow at a given point in the room, and at least one temperature sensor 135 for measuring the room temperature. Other type of setting can be considered, for example a room with multiple HVAC units, or a house with multiple rooms.

Figure 2:
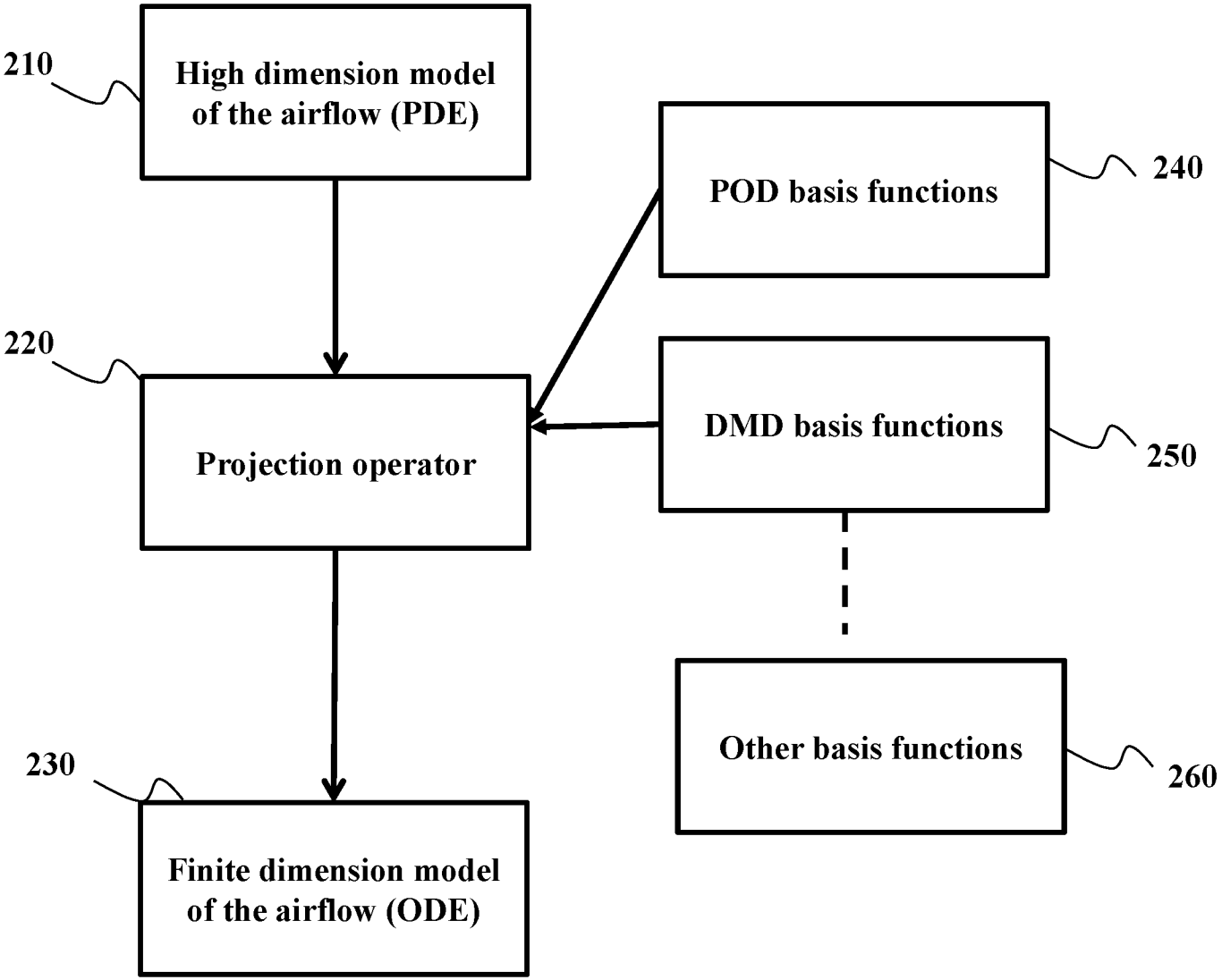
FIG. 2 is a block diagram for the discerption of the projection of a high dimensional model to a low dimensional model.
Figure 3:
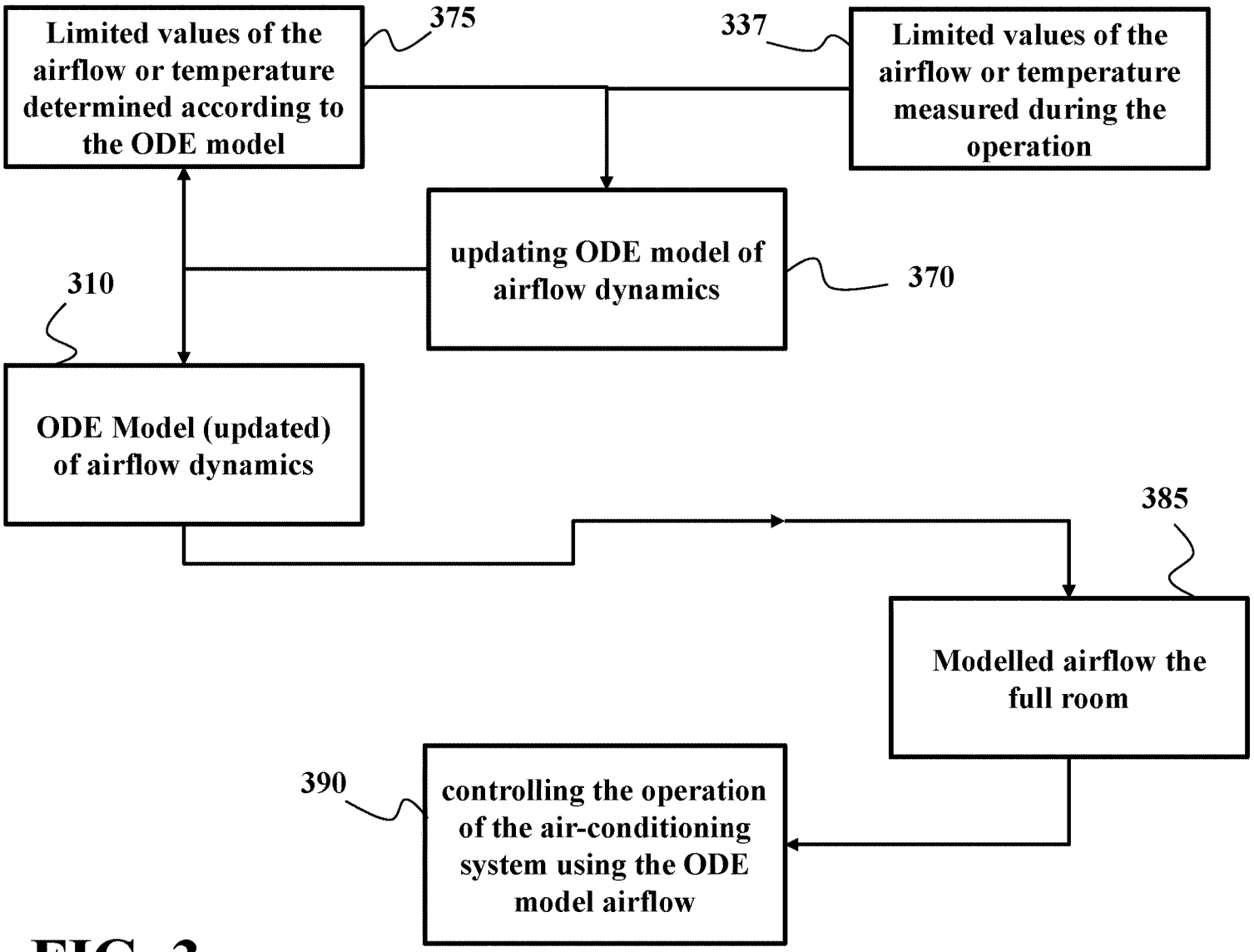
FIG. 3 is a block diagram for the discerption of the estimation of the airflow from an ODE model of the airflow.

As we explained in the Summary Section, the airflow physical model is a complicated one, with an infinite dimension of state space. This model is described by a partial differential equation (PDE). One example of such PDE model of airflow in a room is the so-called Boussinesq equation. As shown in FIG. 2, a high dimension model 210, is projected using a projection operator 220, into a simplified finite dimension model 230. This finite dimension model often takes the form of an ordinary differential equation (ODE). The projection operator 220, is based on a selection of bases functions for the finite dimension model, sometimes referred to as reduced order model (ROM). There are many possible choices of basis functions, and hence many possible choices of projection operators. For example, in one embodiment of the present invention, we propose to use the basis function known as Proper orthogonal decomposition (POD) functions 240. In another embodiment, we propose to use the dynamic mode decomposition (DMD) basis function 250.

Once the ODE model has been obtained, it can be run forward in time to obtain some prediction of the airflow at some limited locations in the room 375. These values are then compared to some limited measurements of the airflow at the same limited locations in the room 337. The error between the prediction values and the measurement values is then used to update the ODE model of the airflow 370. The updated ODE model of the airflow 310 is used to predict the full values of the airflow in all locations of the room 385. Finally, the predicted values of the airflow are used to control the operation of the air conditioning system to achieve some desired temperature and comfort level in the room 390.

As discussed before in the Summary Section, the projection 220, from the PDE model 210, to the ODE model 230, preservers the physical coefficients of the PDE model, and preserve with it any uncertainty which might affect the values of these coefficients. Indeed, for example the viscosity coefficient which represents how viscous is the airflow motion in the room, can be uncertain, since it depends on many varying parameters in the room, e.g., the geometry of the room, the number of the people in the room, the functioning of the air conditioning unit in the room, the door being open or closed, etc. To deal with this problem of imprecise coefficients of the ODE model, we propose to robustify the ODE model by adding a robust closure model 4080*b*.

Figure 4:
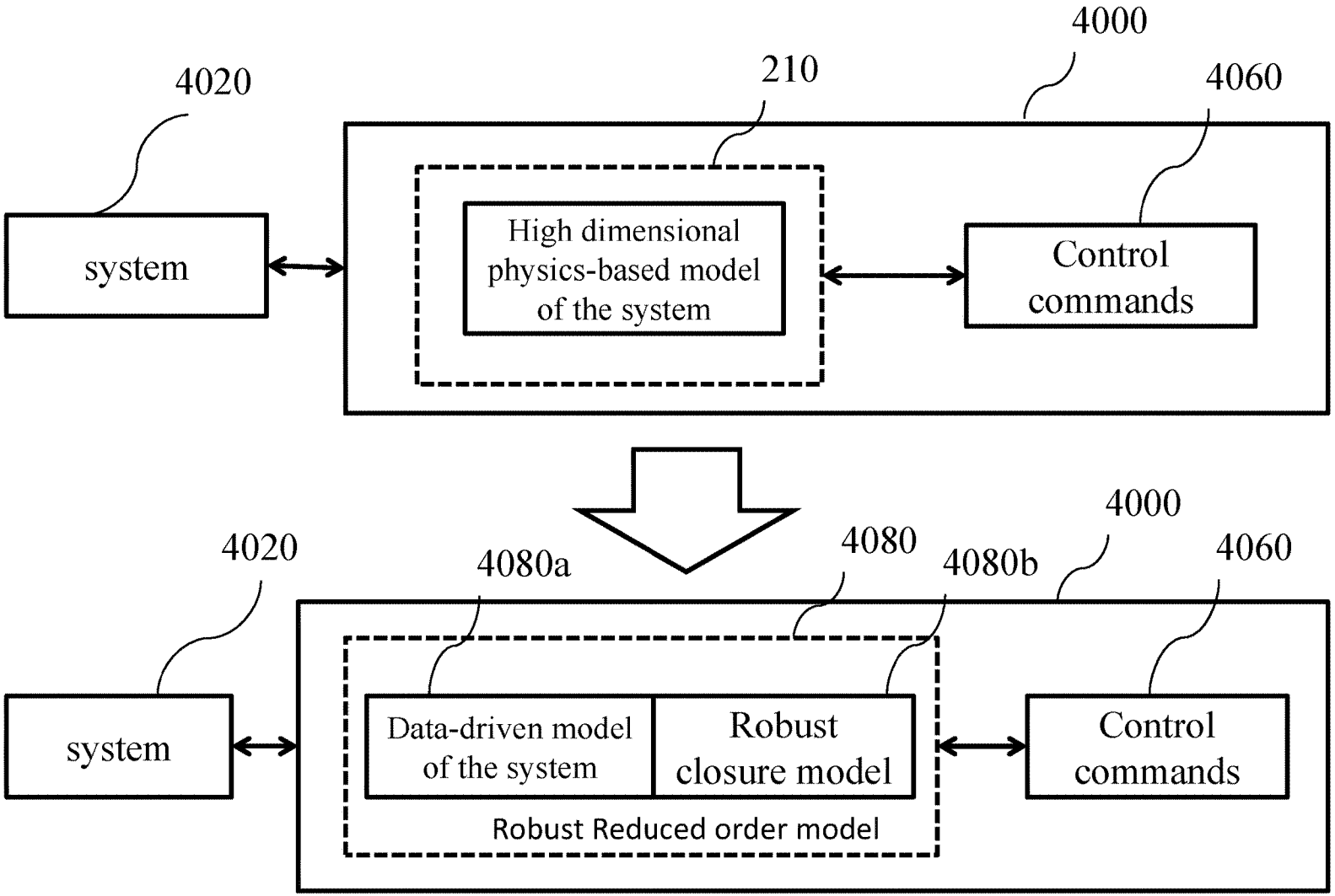
FIG. 4 is a block diagram showing a schematic overview of a novel principle for controlling an operation of a system, according to another embodiment of the present invention.

FIG. 4 shows a schematic overview of principles used by some embodiments for controlling an operation of a system. Some embodiments provide a control apparatus 4000 configured to control a system 4020. For example, the apparatus 4000 can be configured to control continuously operating dynamical system 4020 in engineered processes and machines. Hereinafter, "control apparatus" and "apparatus" may be used interchangeable and would mean the same. Hereinafter, "continuously operating dynamical system" and "system" may be used interchangeably and would mean the same. Examples of the system 4020 are HVAC systems, LIDAR systems, condensing units, production lines, self-tuning machines, smart grids, car engines, robots, numerically controlled machining, motors, satellites, power generators, traffic networks, and the like. Some embodiments are based on realization that the apparatus 4000 develops control commands 1060 for controlling the system 4020 using control actions in an optimum manner without delay or overshoot and ensuring control stability.

The control apparatus 4000 uses model-based control and prediction techniques, such as model predictive control (MPC), to develop the control commands 4060 for the system 4020. The model-based techniques can be advantageous for control of dynamic systems. For example, the MPC allows a model-based design framework in which the system 4020 dynamics and constraints can directly be taken into account. The MPC develops the control commands 4060, based on the model of the system 210. The model 210 of the system 4020 refers to dynamics of the system 4020 described using dynamical systems equations, e.g., partial differential equations (PDEs) or ordinary differential equations (ODEs). In some embodiments, the model 210 is nonlinear high dimensional and can be difficult to use in real-time. For instance, even if the nonlinear model is exactly available, estimating the optimal control commands 4060 are essentially a challenging task since a partial differential equation (PDE) describing the dynamics of the system 4020, named Hamilton-Jacobi-Bellman (HJB) equation needs to be solved, which is computationally challenging.

The method illustrated in FIG. 1A uses physics principle to design the model 210. In contrast with such physics-based modeling approaches, some embodiments of the present invention can use operational data measured from sensors of the system 4020 to design a model, e.g., a reduced order model ODE 4080*a*, of the control system and, then, to use the data-driven reduced order model ODE 4080*a* to control the system using various model-based control methods.

It should be noted that the objective of some embodiments is to determined actual model of the system from data, i.e., such a model that can be used to estimate behavior of the system. For example, it is an object of some embodiments to determine the model of a system from data that capture dynamics of the system using differential equations. Additionally, it is an object of some embodiments to learn from data a robust model having similar accuracy as physics-based models.

To simplify the computation, some embodiments formulate a reduced order model ordinary differential equation (ODE) 4080*a* to describe the dynamics of the system 4020. The reduced order model ODE 4080*a* may be referred to as a data-driven model 1080*a* of a system. In some embodiments, the reduced order model ODE 4080*a* may be formulated using dynamic mode decomposition (DMD) technique. However, in some cases, the reduced order model ODE 4080*a* fails to reproduce actual dynamics (i.e., the dynamics described by the PDE) of the system 4020 in cases of uncertainty conditions. Examples of the uncertainty conditions may be the case where boundary conditions of the PDE are changing over a time or the case where one of coefficients involved in the PDE are changing, i.e., wear and tear of the system over time.

To that end, some embodiments formulate a closure model 1080*b* that robustifies the DMD data-driven reduced order model ODE 4080*a*, by covering the cases of the uncertainty conditions. In some embodiments, the closure model 1080*b* may be a nonlinear function of a state of the system 4020 capturing a difference in behavior (for instance, the dynamics) of the system 4020 according to the ODE. The robust closure model 4080*b* may be formulated using robust nonlinear control.

In other words, the physics-based model of the system 210 is approximated by a combination of a reduced order model ODE 4080*a* and a robust closure model 4080*b*, and the robust closure model 408*b* is designed using nonlinear robust control methods. In such a manner, the model approaching the accuracy of physics-based model is learned from data in the form of DMD model 1080*a* robustified by a robust closure model 4080*b*.

To that end, some embodiments determine a gain and include the gain in the robust closure model 4080*b* to optimally reproduce the dynamics of the system 4020. In some embodiments, the gain may be adapted using optimization algorithms. The reduced order model 4080 comprising the reduced order model ODE 4080*a*, the closure model 4080*b* with the adapted gain reproduces the dynamics of the system 4020. Therefore, the model 4080 optimally reproduces the dynamics of the system 4020. Some embodiments are based on realization that the model 4080 comprises a smaller number of parameters than the physics-based high dimensional model. To that end, the reduced order model 4080 is computationally less complex than the model 210 that describes the physical model of the system 4020. The control polices (commands) 4060 may be determined using the model 4080. The control policies 4060 directly map the states of the system 4020 to control (generate) commands to control the operations of the system 4020. Therefore, the reduced model 4080 is used to design control for the system 4020 in an efficient manner, which is computationally tractable.

Figure 5:
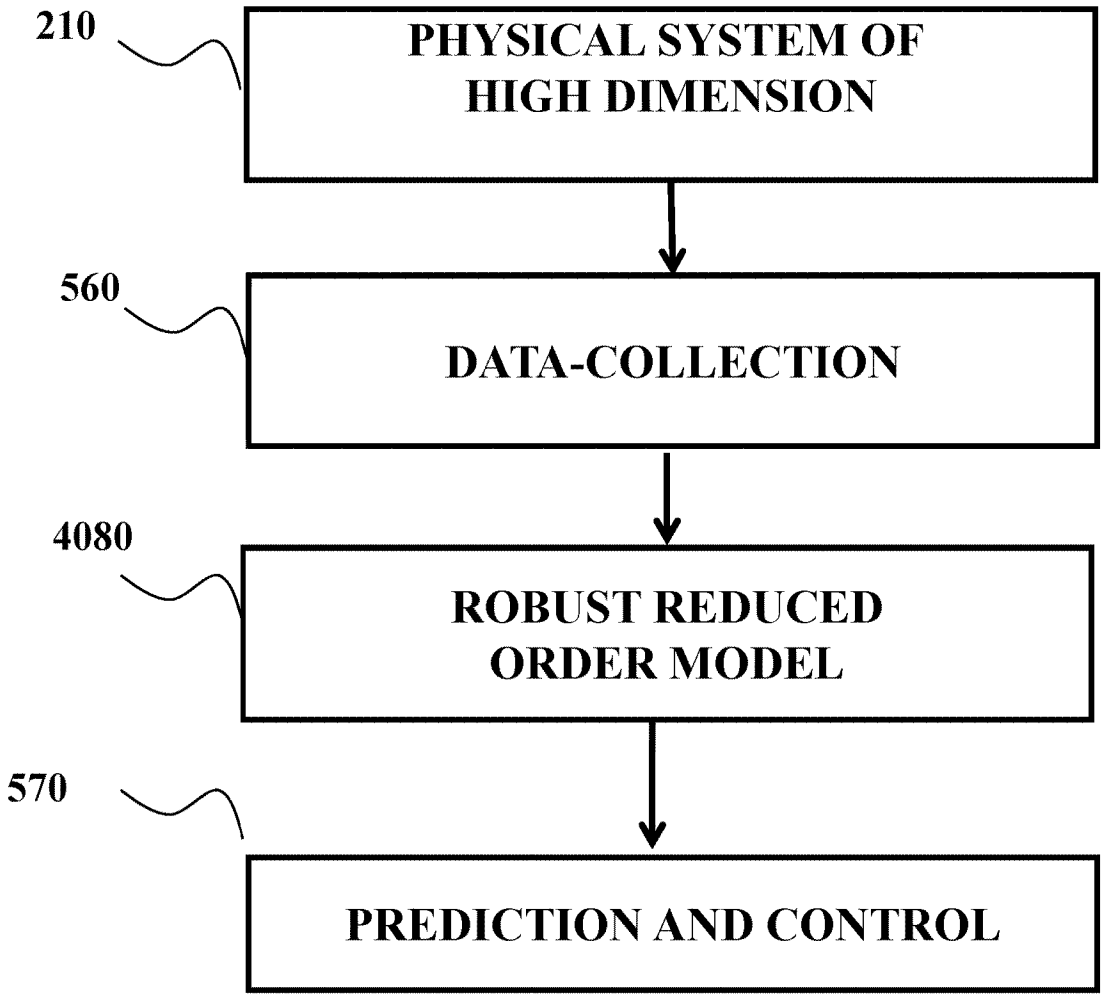
FIG. 5 is a block diagram of relationship between high dimension system and robust model reduction in an embodiment of the invention.

In some embodiments of this invention, represented in FIG. 5, we consider the system with high dimension 210, e.g., air conditioning system with millions of states to represent the airflow and the temperature values distributed all over a room. We then place multiple sensors on the system to collect data 560, which is then used to generate a robust data-driven reduced order model (ROM) 4080. This robust data-driven ROM is then used for prediction and control of the actual system 570.

Figure 6:
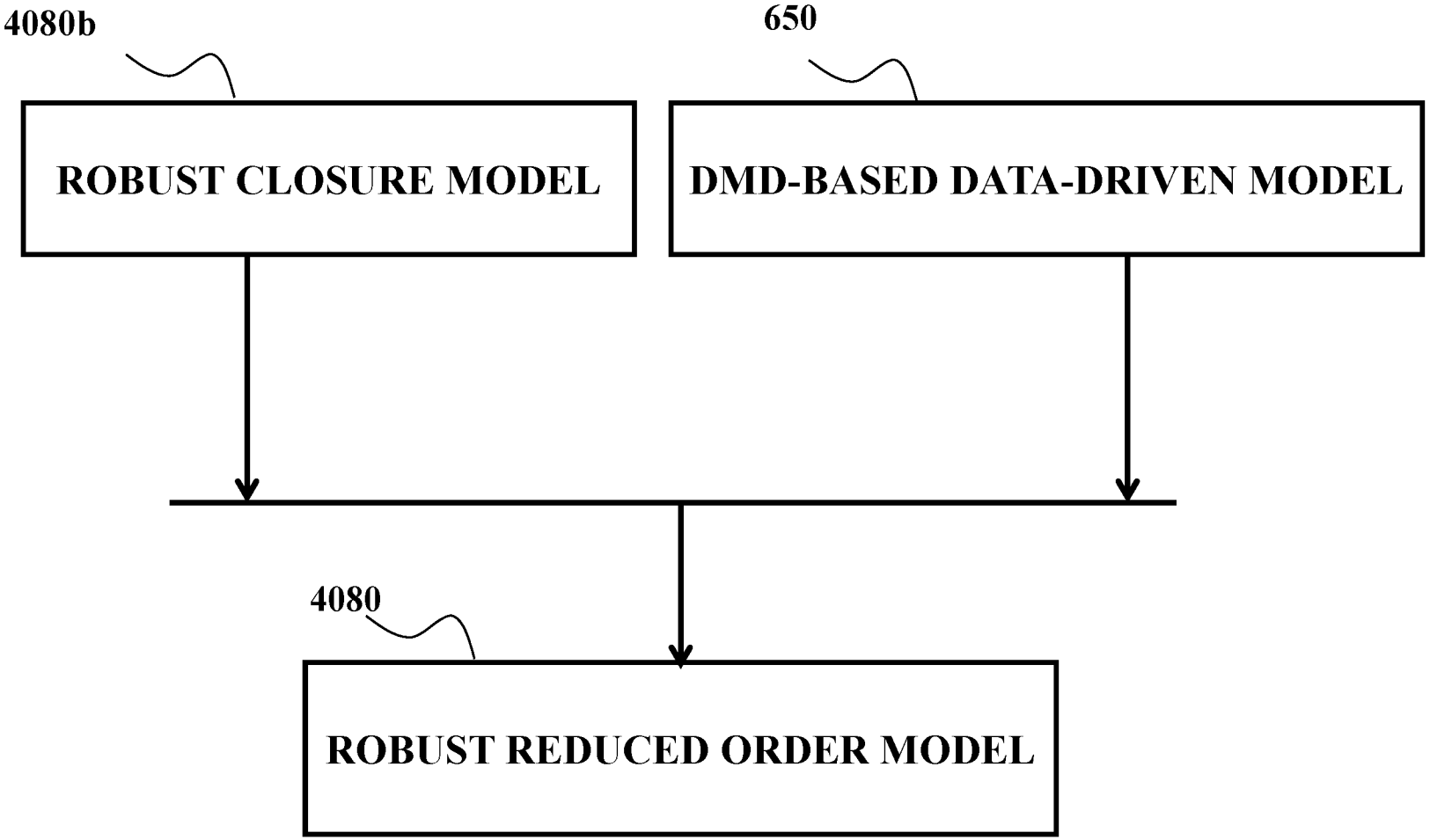
FIG. 6 is a block diagram of a robust model reduction algorithm based on closure model and DMD-based model in an embodiment of the invention.

In some embodiments of this invention, represented in FIG. 6, the data-driven ROM 4080, is obtained by using a dynamic mode decomposition (DMD) model 650, to which a robust closure model 4080*b* is added to produce a robust DMD-based reduced order model 4080.

Figure 7:
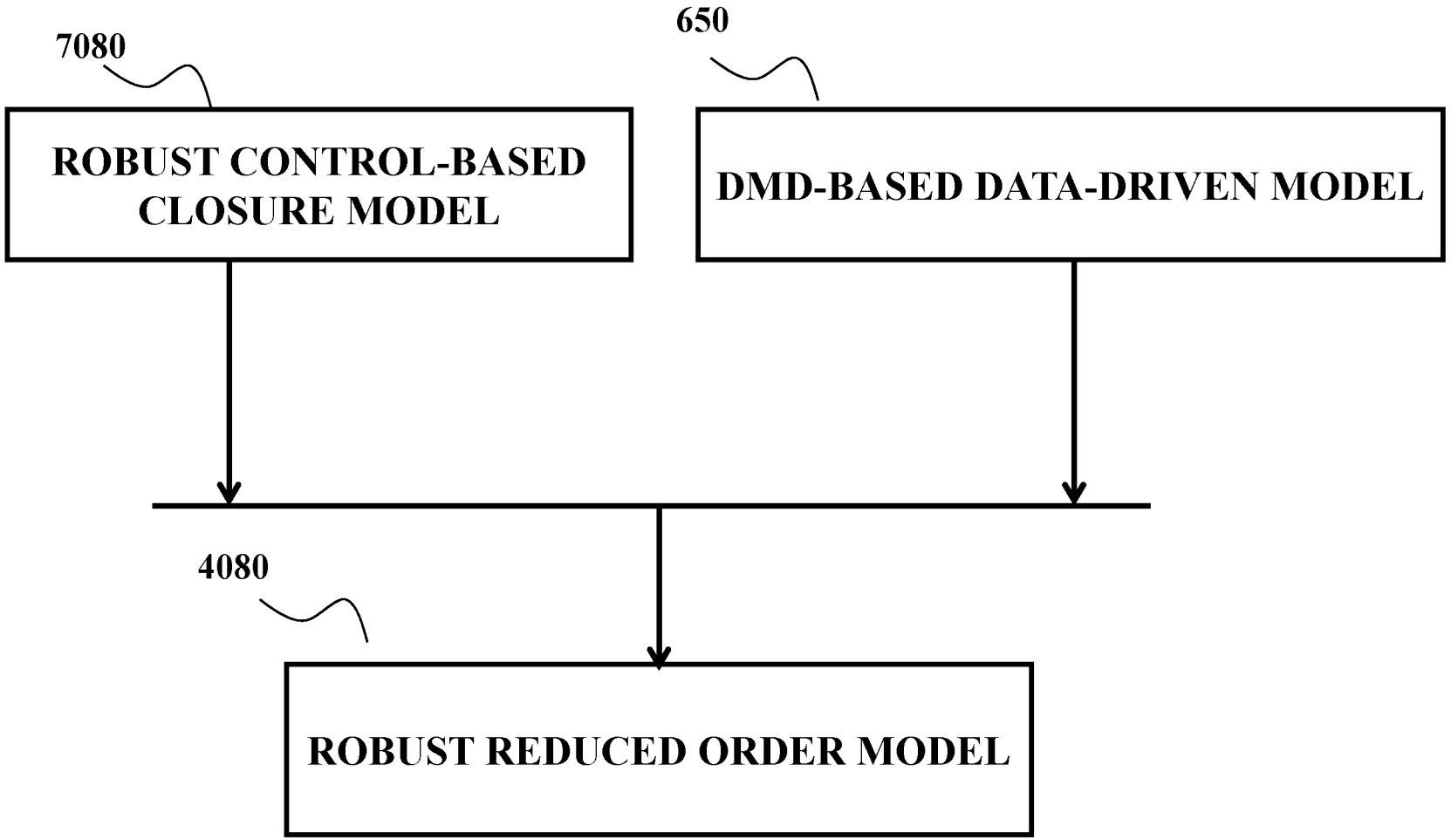
FIG. 7 is a block diagram of a robust model reduction algorithm based on robust control-based closure model and DMD-based model in an embodiment of the invention.
Figure 8:
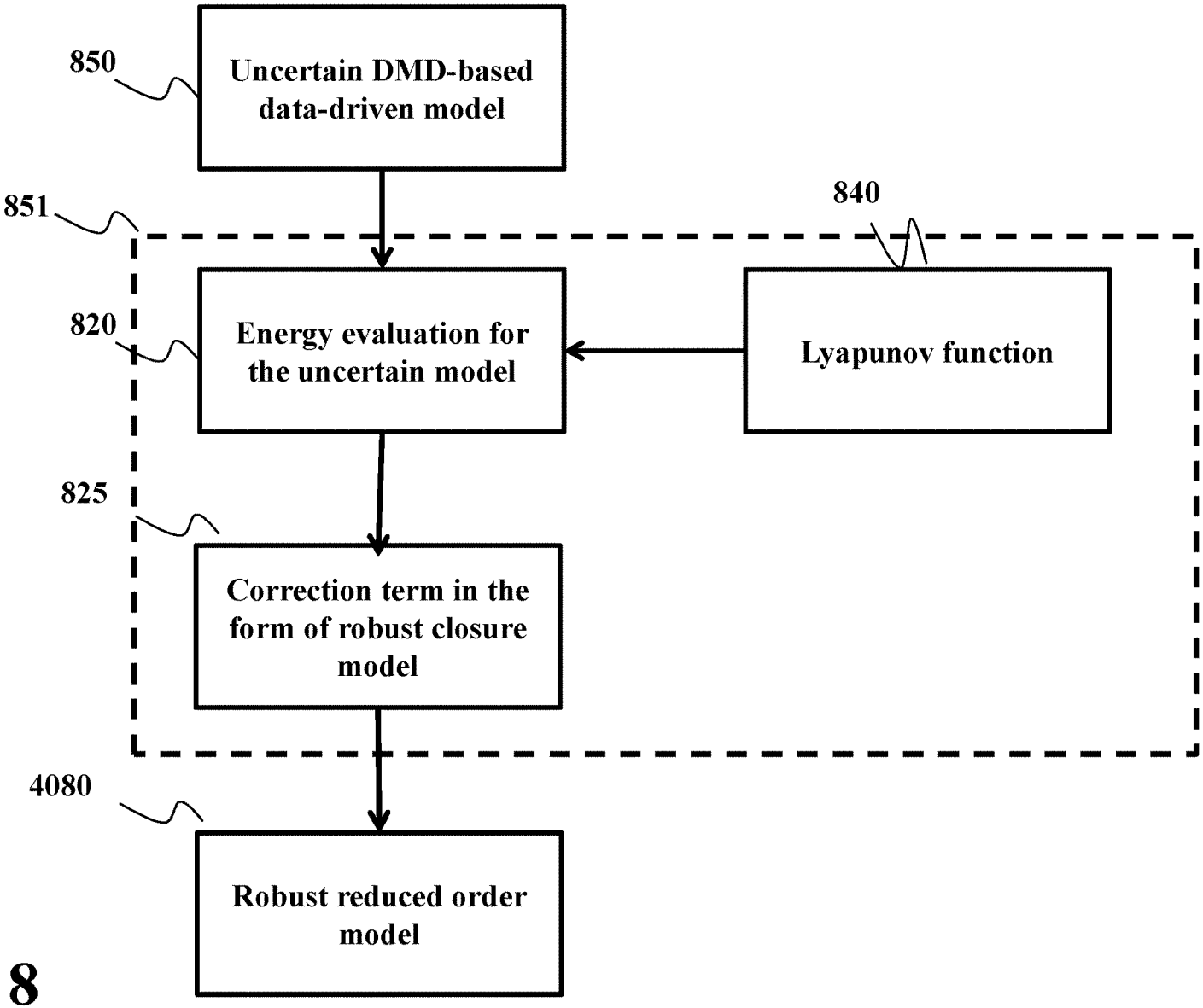
FIG. 8 is a block diagram of a robust model reduction algorithm based on Lyapunov function according to an embodiment of an invention.

In some embodiments of this invention, represented in FIG. 7, the robust closure model 4080*b* is designed based on robust control methods 7080. For example, in some embodiment, as in FIG. 8, the uncertain DMD-based data driven model 850 is robustified 851, using a Lyapunov function 840, which is used to evaluate the energy of the uncertain model 820, and from this energy evaluation a correction term in the form of a closure model is obtained 825. Finally, the addition of the uncertain DMD-based model together with the robust closure model leads to a robust reduced order model 4080.

Figure 9:
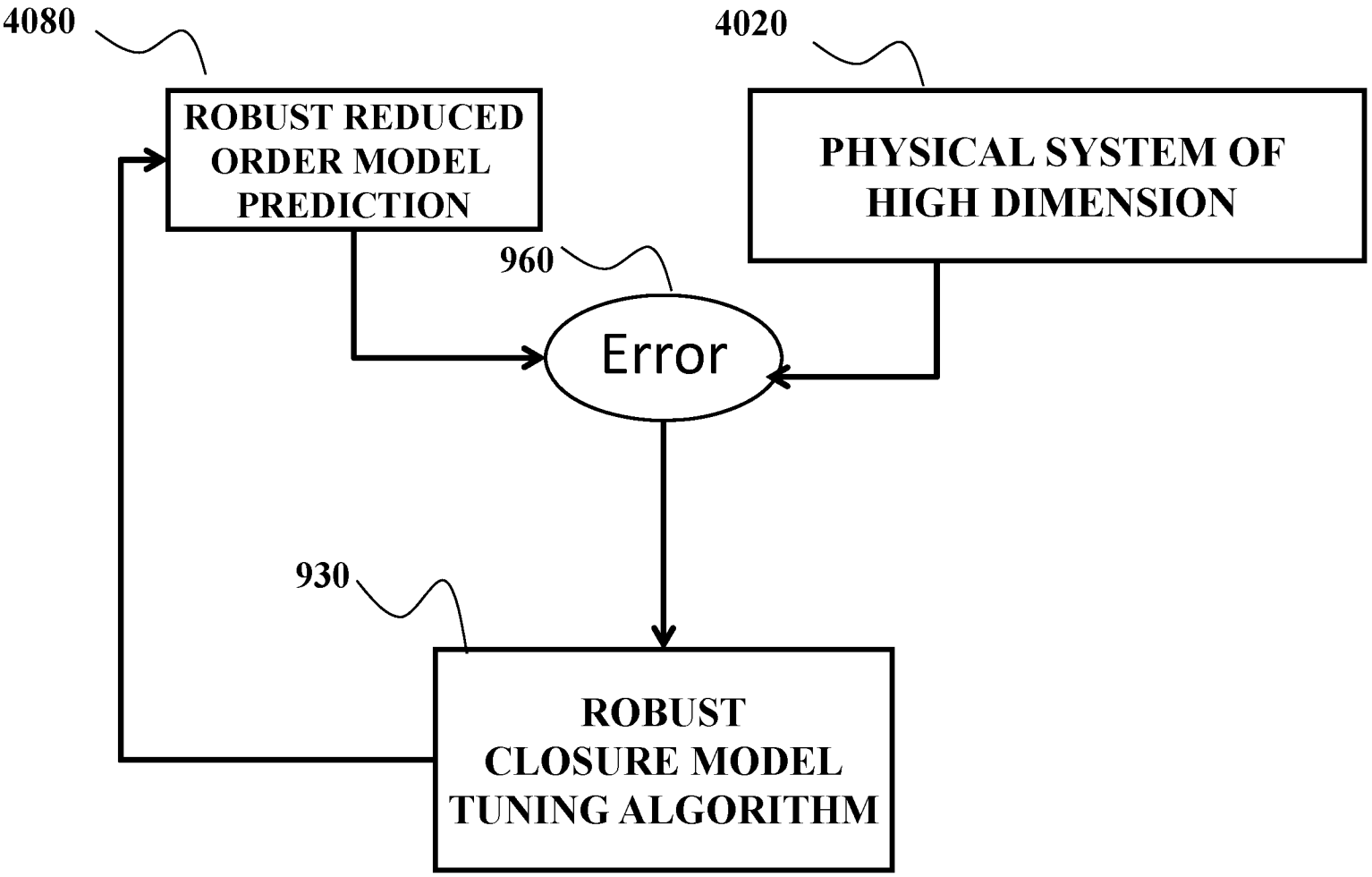
FIG. 9 is a block diagram of a robust closure model tuning according to an embodiment of an invention.
Figure 10:
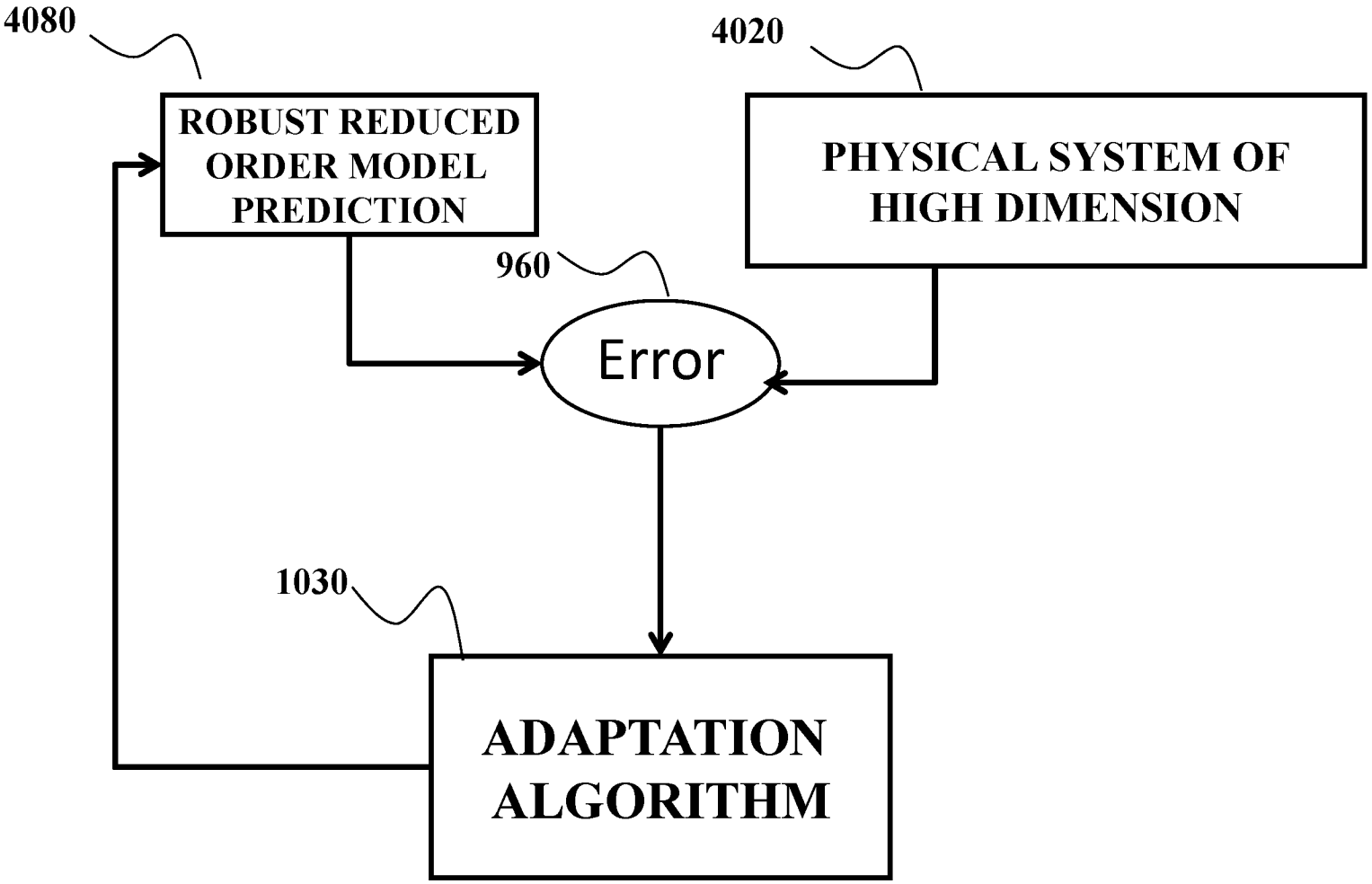
FIG. 10 is a block diagram of a robust closure model adaptation algorithm according to an embodiment of an invention.

FIG. 9 is a schematic of a robust closure model tuning according to an embodiment of an invention. The other embodiments are also shown in FIGS. 10, 11, 12, 13 and 14. FIG. 10 is a schematic of a robust closure model adaptation algorithm.

Figure 11:
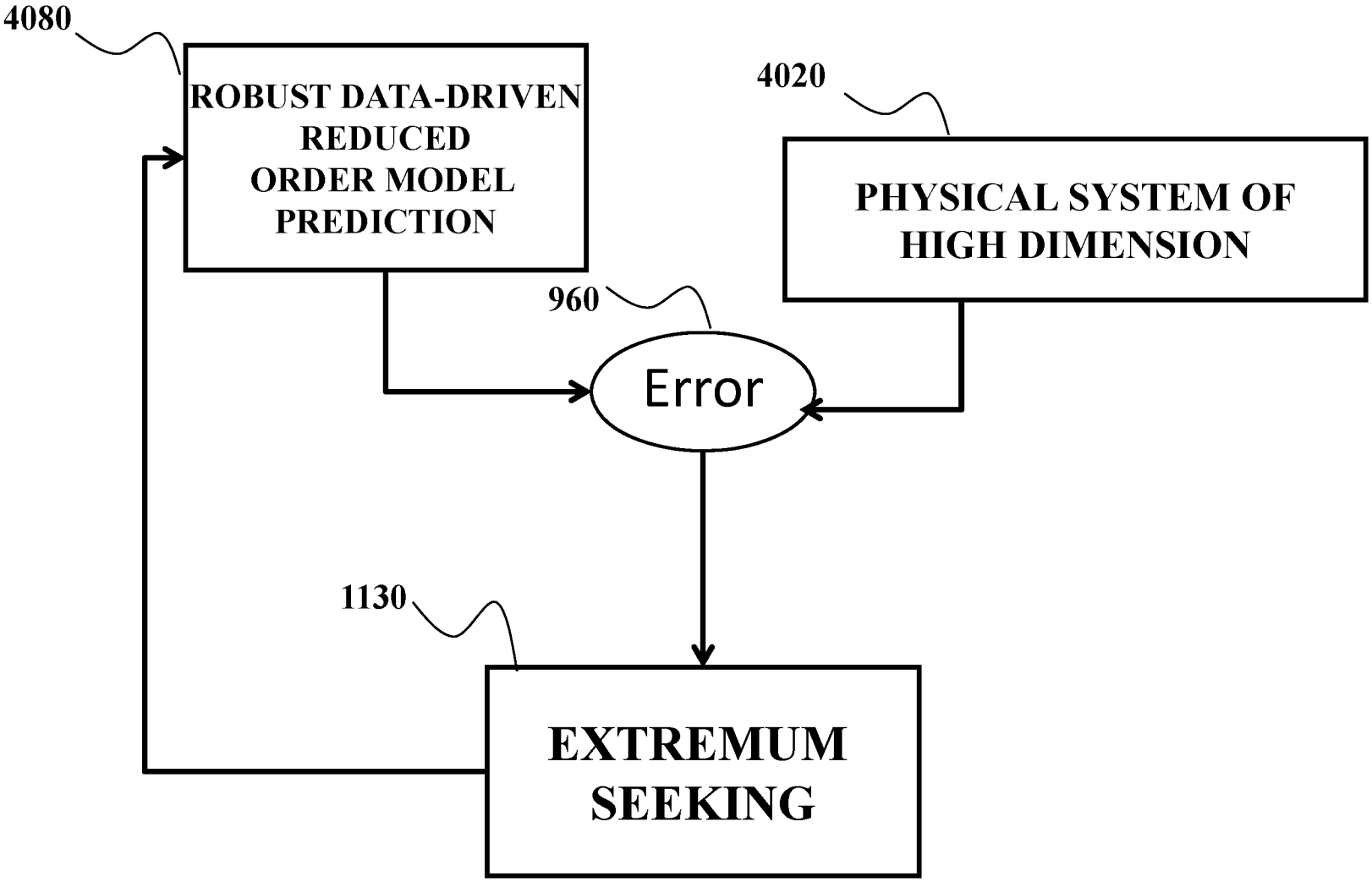
FIG. 11 is a block diagram of an optimal extremum-seeking based robust model reduction according to an embodiment of an invention.
Figure 12:
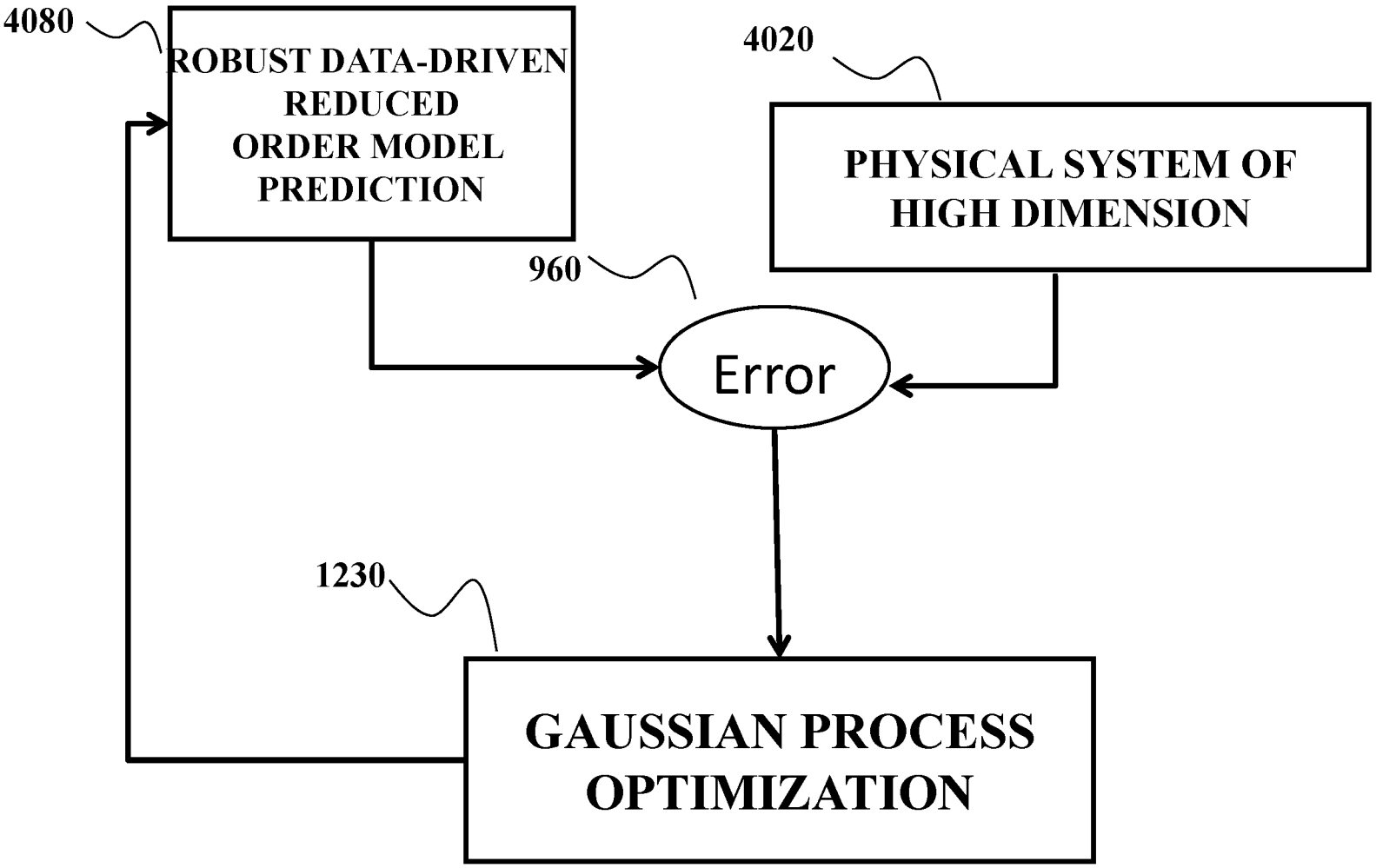
FIG. 12 is a block diagram of an optimal Gaussian process based robust model reduction according to an embodiment of an invention.
Figure 13:
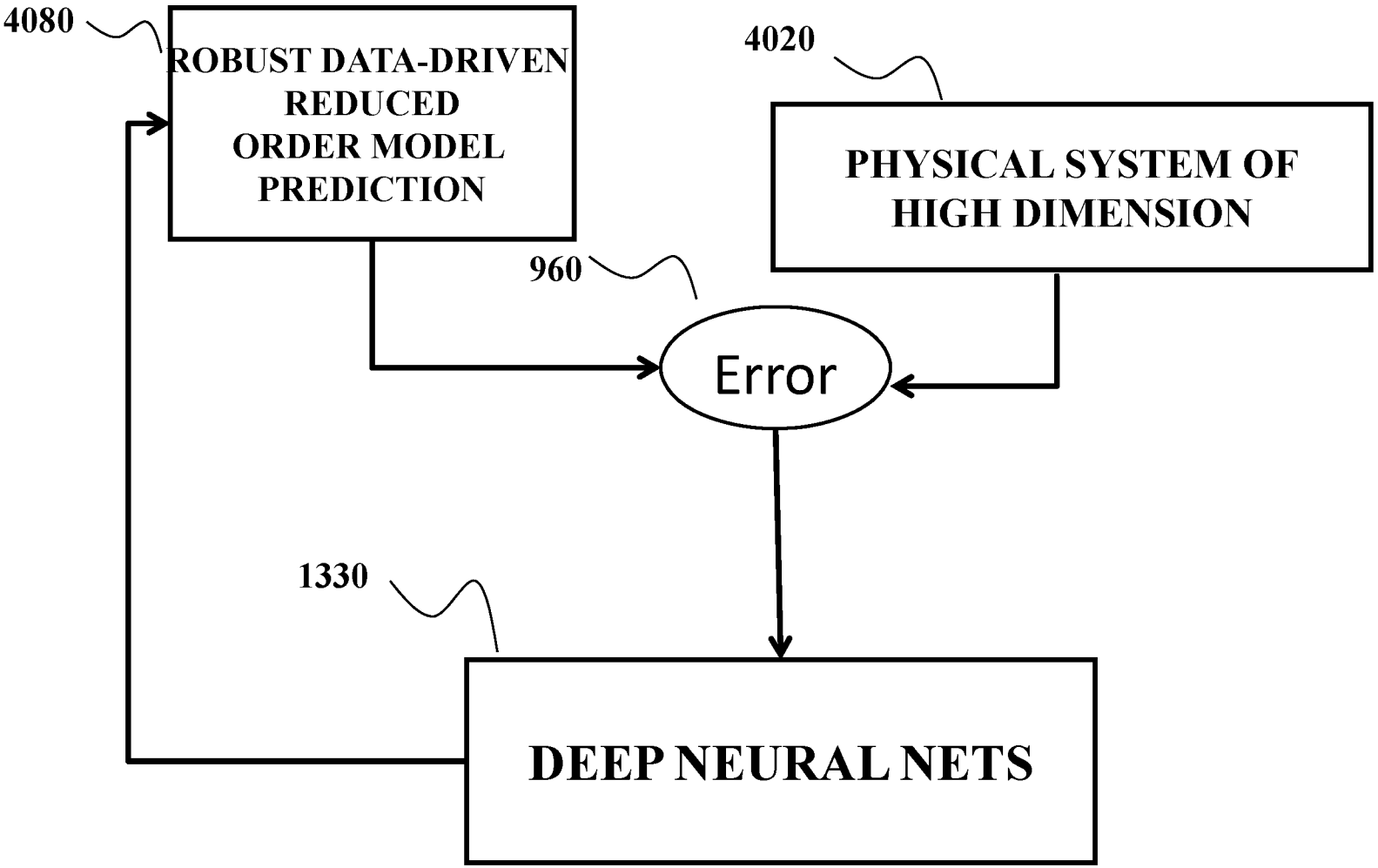
FIG. 13 is a block diagram of a deep neural network learning process based robust model reduction according to an embodiment of an invention.
Figure 14:
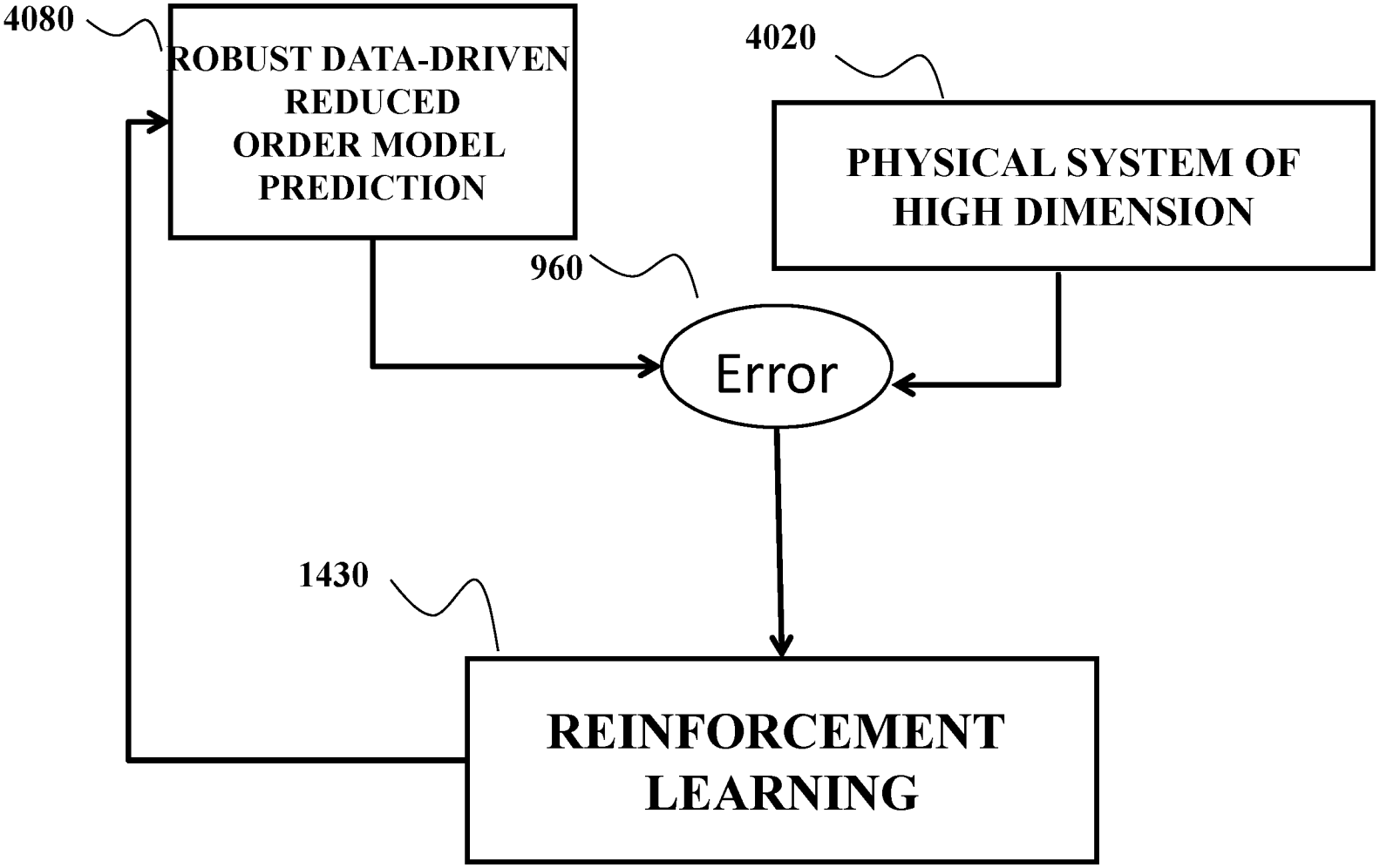
FIG. 14 is a block diagram of a reinforcement learning process based robust model reduction according to an embodiment of an invention.

FIG. 11 is a schematic of an optimal extremum-seeking based robust model reduction, FIG. 12 is a schematic of an optimal Gaussian process based robust model reduction, FIG. 13 is a schematic of a deep neural network learning process based robust model reduction; FIG. 14 is a schematic of a reinforcement learning process based robust model reduction.

The robust closure model 825 is further tuned 930 based on the difference 960 between measurements from the physical system 210, and predictions from the robust reduced order model 940. This tuning can be realized by the tuning of some parameters of the closure model, e.g. tuning of basis functions' coefficients, or tuning of some physical coefficients appearing in the closure model, which can be implemented using an adaptation algorithm 1030 (FIG. 10), wherein such adaptation algorithm can be in the form of an extremum seeking optimization algorithm 1130 (FIG. 11), a Bayesian optimization algorithm from the family of Gaussian process-based optimization 1230 (FIG. 12), deep neural networks 1330 (FIG. 13), or reinforcement learning methods 1430 (FIG. 14).

Figure 15A:
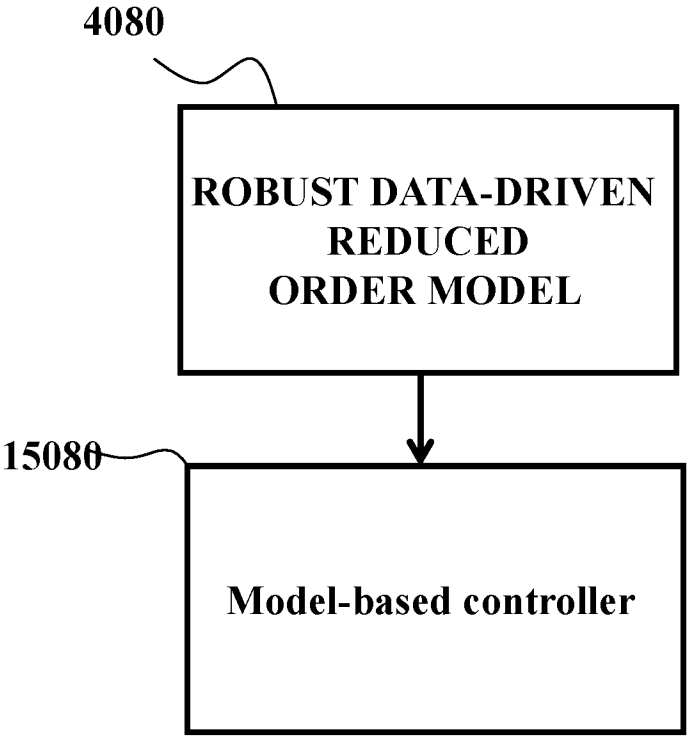
FIG. 15A is a block diagram of a model-based controller wherein the model part is based on a robust reduced order model.

FIG. 15A describes an embodiment where the robust data-driven reduced order model 4080 is used to design a model-based controller 15080. This model-based controller will then be used to provide a warm start to the learning data-driven controller 16188.

Figure 15B:
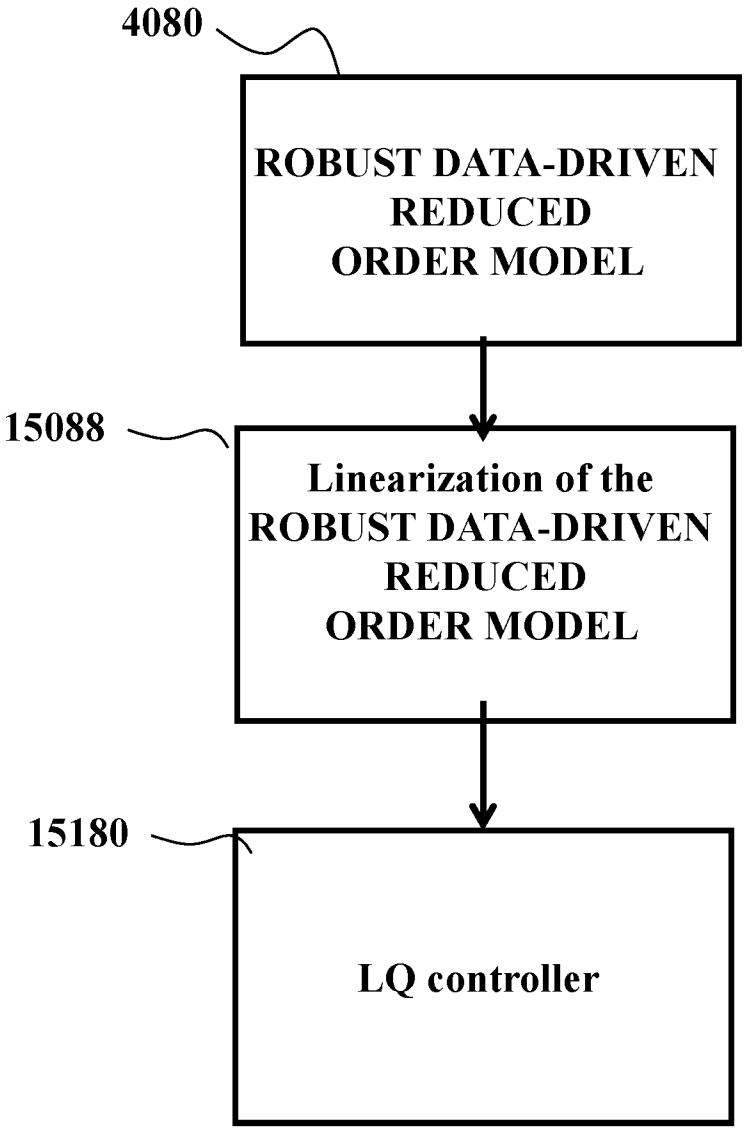
FIG. 15B is a block diagram of an LQ model-based controller wherein the model part is based on a linearization of the robust reduced order model.
Figure 16:
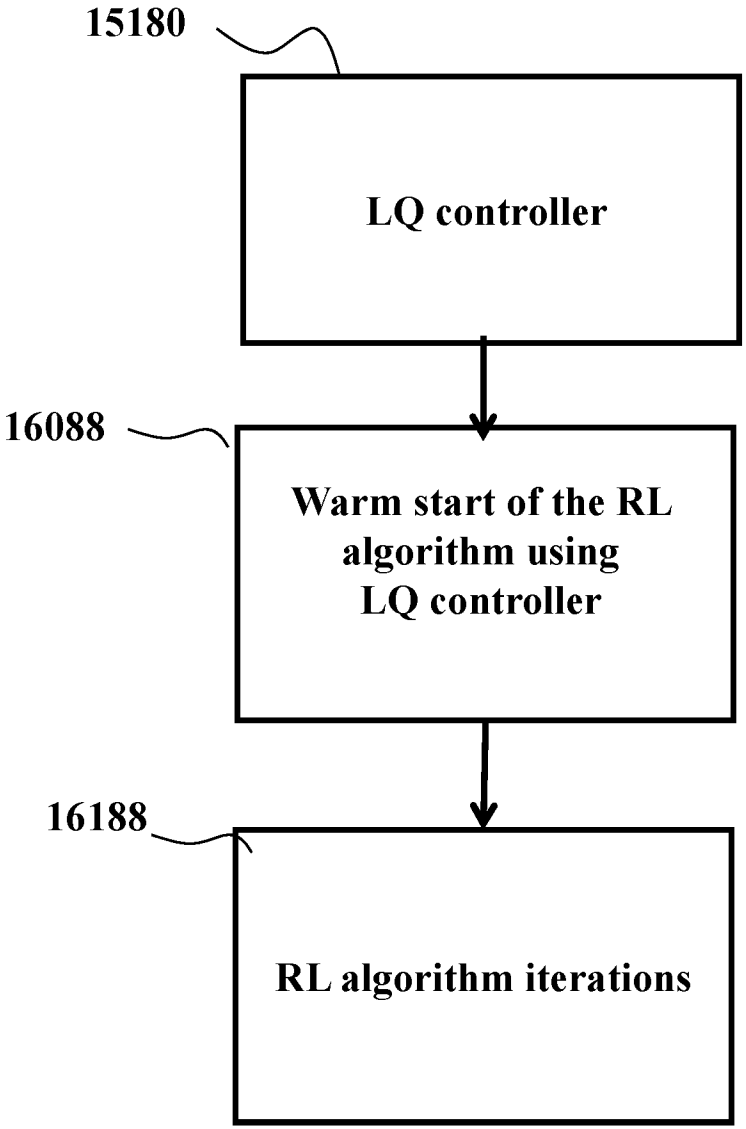
FIG. 16 is a block diagram of an RL controller wherein the initiation of the RL algorithm is based on a warm start LQ controller.

Indeed, as seen in FIGS. 15B, and 16, the robust data-driven reduced order model 4080 can be used to perform a tangent linearization of the model around the setpoint 115 of the system 15088. The obtained linear model can then be used to design a linear quadratic (LQ) optimal controller 15180. Such controller 15180 will then be used as a warm start 16088 for the reinforcement learning (RL) data-driven controller 16188. This RL controller is data-driven and can be implemented in real-time based on sensor measurements only, without the need of system model.

Figure 17A:
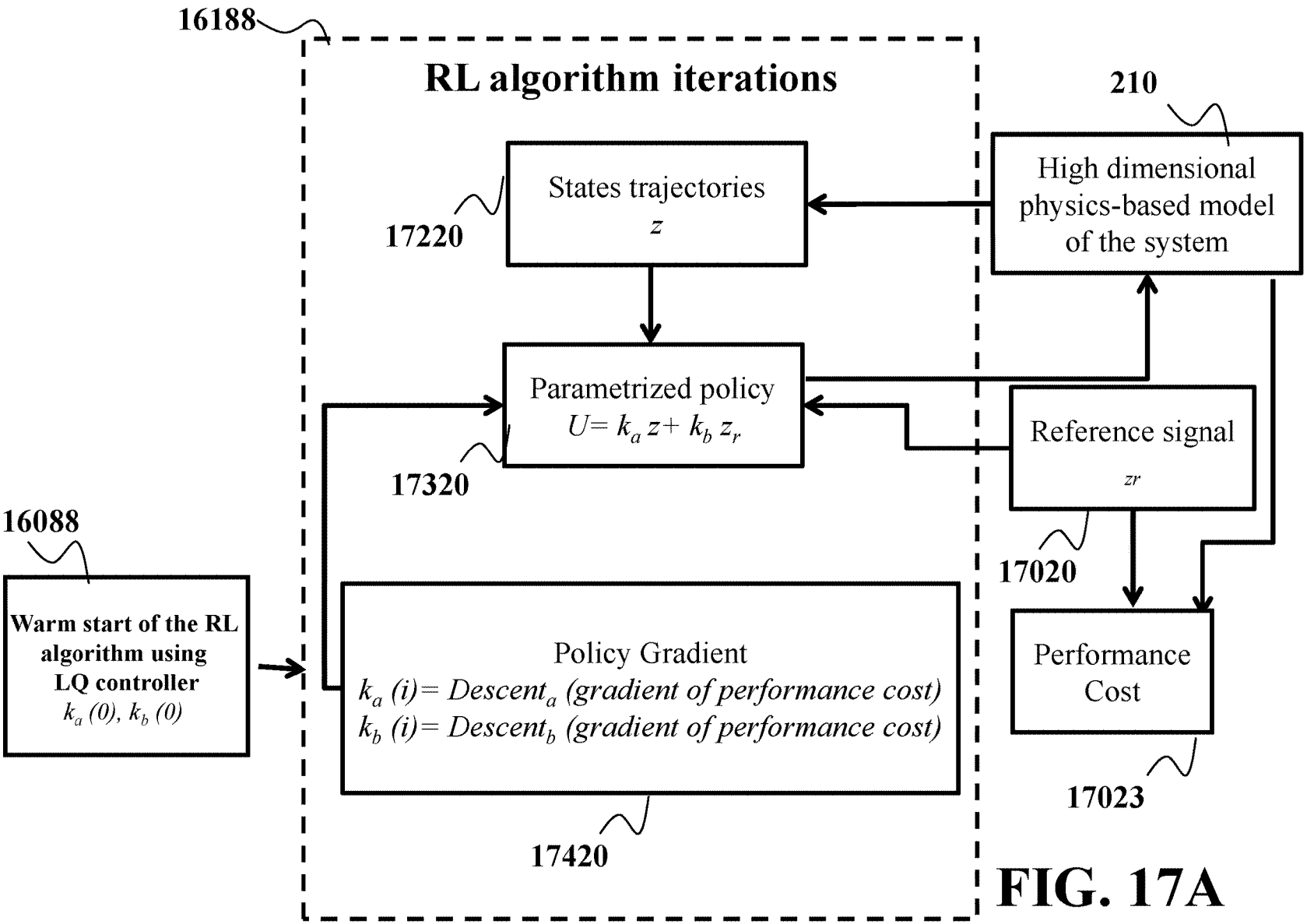
FIG. 17A is a block diagram of a data-driven policy gradient algorithm for high dimensional system.

FIG. 17A describes the high-level steps of the RL algorithm. We want that a system 4020, which is modeled by a high dimensional model 210, to track a reference signal zr 17020, which can be a desired temperature level for a room. To do so, we propose to parametrize the control policy u 17320 as u=ka z+kb zr, where z is the trajectories over time of the states of the system 4020, represented by the states of the model 210, and ka, kb are feedback gains of the control policy, that will be learned using an RL policy gradient (PG) algorithm 17420. Here by policy, we mean a sub-module of the algorithm that can be implemented to generate the control actions from sensor measurements in real-time. The RL policy gradient algorithm will tune the gains ka, kb using a Descenta(.), and Descentb(.) functions 17420, respectively. This tuning can be programmed to happen over any desired time interval length, e.g., minutes or hours, depending on the desired functioning of the system. For instance, if the system optimal performance is critical, e.g., hospital operating rooms HVAC system, then we can set the tuning of the policy to be accelerated over a time scale of minutes. On the other hand, if the optimality of the system is not critical, e.g., wear-house environment, then the tuning of the policy can be set to be on a slower scale of hours. These functions have as argument the gradient of a performance cost 17423.

Figure 17B:
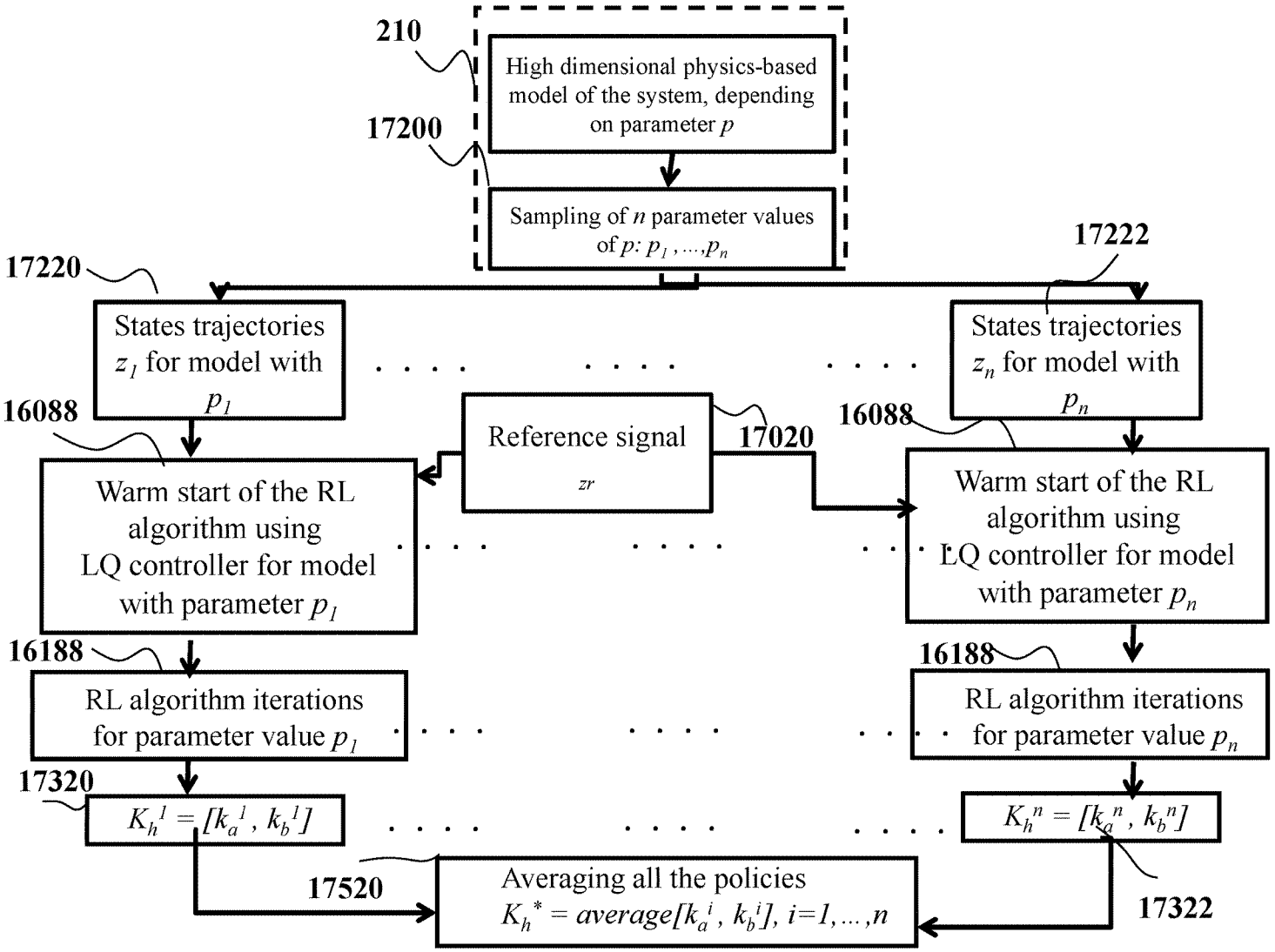
FIG. 17B is a block diagram of a robust domain randomization data-driven policy gradient algorithm for high dimensional system.

In another embodiment, we propose to robustify the RL controller with respect to model uncertainties, FIG. 17B. Indeed, if we consider that the high dimensional physics-based model of the system depends on an uncertain parameter p 210, which could be a vector of parameters, then we propose the following: we first sample the value of the parameter p to obtain a set of parameter values {p1, . . . , pn} 17200. Then, we design n parallel RL controllers, for each parameter value pi, i∈{1, . . . , n}. For instance, we start by solving the high dimensional physics-based model 210 for each value of pi which allows us to collect states trajectories of the system for each value of p, e.g., for p1 17220, and all other values of pi, up to pn 17222. Them, we design a warm start controller associated with each value of pi 16088. These warm start controllers will then be used to run the RL algorithm iterations for each value of pi 16188, leading to a set of values for the RL feedback gains Khi=[kai, kbi], i∈{1, . . . , n} 17320-17322. Finally, we compute the average of these gains to obtain our robust optimal RL feedback gains Kh*=average(Khi), i∈{1, . . . , n} 17520.

Let us now put the steps described above using an example of high dimensional model of a system, described by the well-known Burger's equation, which is a simplified model for fluid dynamics, e.g., indoors airflow in a room.

2 Preliminaries

We study the state-feedback control for asymptotic tracking of an arbitrary constant command of Burgers' equation.

The Burgers' Equation.

Consider a domain $\Omega \subset R$ and a spatial field $z(xx,t):\Omega \times R+ \rightarrow R$, where xx and t represent spatial and temporal coordinates, respectively. Let the temporal dynamics of z(xx,t) be governed by high-dimension PDE Burgers' equation defined in one spatial dimension as $$\frac{\partial z}{\partial xx} + z\frac{\partial z}{\partial xx} - \nu\frac{\partial^2 z}{\partial xx^2} = u(xx, t), \tag{2.1}$$

where ν is a constant viscosity parameter of the fluid and u(xx,t) is the control input term whose structure will be specified shortly. We consider the domain Ω=[0,1] with periodic boundary conditions, z is the state of the system which can represent the airflow amplitude, and we employ the initial condition to be z(xx,t=0)=1. Although Burgers' equation is well known for developing discontinuous shock waves in its inviscid limit ν=0, we adopt the weakly viscous case ν=10-4 where its solutions approach shock-like behavior but remain smooth. Furthermore, we design the control input u(xx,t) to have the structure of $$u(xx, t) = \eta(xx) \cdot u(t) = \sum_{i=0}^{n_u-1} \eta_i(xx)u_i(t),$$

where nu is the number of independent scalar control inputs and η(xx) is a spatially distributed forcing support function that maps ui(t), for all i∈{0, . . . , nu−1}, to the field z(xx,t). In particular, we choose the forcing support function to be $$\forall\, i \in (0, \ldots, n_u - 1),\ \eta_i(xx) = \operatorname{sech}\left(10 \cdot \left(xx - \frac{i + 0.5}{n_u}\right)\right).$$

Lastly, we truncate ηi for all i such that any entry that has a value less than 0.9 is set to 0. This specific structure of the forcing support function models the scenario where each actuator can only insert localized controls to a certain region of the domain Ω. This is a realistic setting in industrial heating and air-conditioning applications where a set of distributed devices is considered, but each device can only affect a relatively small region of the state space.

Discretization of Burgers' Equation

The Burgers' equation can be solved numerically by discretizing space and time. We define a state vector $z_t \in R^{nz}$ that contains the values of z at nz equally-spaced points in Ω and at time t=kΔt, where nz is even, k=0, 1, . . . , and Δt is the discrete time step. We also assume that the control input functions are piecewise constant over each discrete time step Δt.

State-Feedback Tracking Control of Burgers' Equation be represented as $u_t \in R^{nu}$. Then, the dynamics of the Burgers' equation (2.1) can be approximated by the discrete-time high-dimensional nonlinear system 210

$$z_{t+1} = f_\nu(z_t, u_t), \tag{2.2}$$

where $f_\nu: R^{nz} \times R^{nu} \rightarrow R^{nz}$ is a time-invariant mapping contingent on the viscosity parameter ν. Specifically, we discretize the space derivatives using a pseudo-spectral method that has exponential convergence properties. Moreover, we discretize the time derivative using a fourth-order exponential time differencing Runge-Kutta method with an internal integration time step denoted as dt. Note that one should choose nz to be sufficiently large and dt to be sufficiently small to ensure the accuracy of the discretized system.

State-Feedback Tracking Control of Burgers' Equation

We are interested in designing a state-feedback controller that enables asymptotic tracking of an arbitrary constant command $z_r \in R^{nz}$. Specifically, we define the LQ tracking cost objective 17423 as $$\mathcal{J} := \limsup_{N\to\infty} \frac{1}{N}\left\{\sum_{t=0}^{N-1}\left((z_t - z_r)^T Q(z_t - z_r) + u_t R u_t\right)\right\} \tag{2.3}$$

$$\text{s.t. } z_{t+1} = f_v(z_t, u_t),\ u_t = \phi(z_0, \ldots, z_t, u_0, \ldots, u_{t-1}), \tag{2.4}$$

where Q≥0 and R>0 are the weighting matrices of the predetermined values, φ maps the available information up to and includes t to the current control input $u_t$. When $z_r$ is set to 0, the LQ tracking problem reduces to the LQ regulation problem. Note that J represents the performance of the system under control policy u, for example, it represents how far is the system operating from the desired temperature, airflow volume, and comfort level. Since $f_v$ is nonlinear, there exist no analytical solutions to compute the optimal state feedback controller φ that achieves the lowest cost in (2.3).

Reduced-Order Model Identification Using DMDc

Note that the dimension of the nonlinear system dynamics $z_t \in R^{nz}$ is of high-dimensional, and thus designing a state-feedback controller φ to solve (2.3) directly could be computationally formidable. Hence, in some embodiment we first perform a dimensionality reduction 220 and then generate a state feedback controller based on the reduced-order model 230. In some embodiment, we use the dynamic mode decomposition with control (DMDc) 250 algorithm DMDc computes a reduced-order linear model (A,B) based on a single snapshot of the nonlinear system trajectories with the time horizon of length T, where T is a design choice but typically satisfies T>>nx to prevent overfitting. Moreover, when nx is chosen appropriately, the resulting low-dimensional state $x_t \in R^{nx}$ can serve as a high-quality approximation of $z_t$ such that $z_t \sim = Ux_t$, where U is the matrix from DMDc containing the modes that span the projection subspace. The reduced-order model generated by the DMDc algorithm leads to the linear system dynamics $$x_{t+1} = Ax_t + Bu_t. \tag{2.5}$$

The initial state $x_0$ is simply the projection of the initial boundary condition $z_0$ to the reduced-order space through $x_t \sim = U^H z_0$.

In some embodiment, we consider that there are uncertainties in the reduced order model (2.5) 850. These uncertainties can stem from parametric uncertainties in the original high-dimensional model 210 denoted in this example by (2.2), or stem from the discarded higher order models in the model reduction step in (2.5).

To deal with such uncertainties, in some embodiments, we propose to introduce an additional term in the reduced order model ODE (2.5), 4080*a*, which we call a robust closure model denoted by $u_{cl}$ 4080*b*, such that the new robust. reduced order model 4080 is written as $$x_{t+1} = Ax_t + Bu_t + u_{cl}(g, x_t) \tag{2.6}$$

where g is a vector of gains parametrizing the closure term. The design of such robust closure model 851 can be done using robust-control methods 7080. In some embodiments, the robust-control method can be based on a Lyapunov function 840, which allows for an energy evaluation of the uncertain model 820, leading to the robust correction term $u_{cl}$ 825, and ultimately to the robust reduced order model (2.6) 4080. The tuning of the gain g of the robust closure model 851, is based on comparing 960 measurements from system 4020 to predictions from the robust reduced order model 4080, via a robust closure model tuning algorithm 930. This tuning algorithm can be implemented using an adaptation algorithm 1030, such as an extremum seeking algorithm 1130, a Gaussian process optimization algorithm 1230, a deep neural network supervised learning algorithm 1330, or a reinforcement learning algorithm 1430. Next, the obtained tuned robust closure model 4080, can be used to design a model-based controller 15080. In some embodiments, we propose to design a linear quadratic (LQ) controller 15180, based on a linearization 15088 of the robust reduced order model 4080. In another embodiment, we propose to use a robust linear controller such as H-infinity to design the controller 15180. Yet in another embodiment, we propose to use a robust linear controller such as linear quadratic Gaussian (LQG) to design the controller 15180.

In our example, such linearization 15088, can be written as:

$$x_{t+1} = AAx_t + Bu_t \tag{2.7}$$

Where $$AA = A + \frac{\partial u_{cl}(g, x_t)}{\partial x_t}.$$

The design of the LQ controller 15180 is presented next.

Infinite-Horizon LQR Controller 15180

In one embodiment, we propose to use the following infinite-horizon (linear-quadratic regulator) LQR controller 15180 for a warm start control of the RL algorithm 16088.

Consider the discrete-time linear dynamical system $$x_{t+1} = AAx_t + Bu_t \tag{2.8}$$

where $x_t \in R^n$ is the state; $u_t \in R^m$ is the control input; $AA \in R^{n\times n}$ and $B \in R^{n\times m}$ are system matrices unknown to the control designer; and the initial state $x_0 \in R^n$ is sampled from a zero-mean distribution D that satisfies Cov(x0)=Σ0>0. The goal in the LQR problem is to obtain the optimal controller $u_t = \phi_t(x_t)$ that minimizes the cost $$\mathcal{J}_\infty := \mathbb{E}_{x_0\sim D}\left[\sum_{t=0}^{\infty}\left(x_t^T Q x_t + u_t^T R u_t\right)\right] \tag{2.9}$$

where Q>0 and R>0 are symmetric positive-definite weightings chosen by the control designer. For the LQR problem as posed to admit a solution, we require (AA,B) to be stabilizable. Note that here Q>0 implies the observability of (AA,Q1/2). Then, the unique optimal LQR controller is linear state feedback, i.e., $u^*_t = -K^* x_t$, and $K^* \in R^{m\times n}$, which with a slight abuse of terminology we will call optimal control policy, can be computed by $$K^* = \left(R + B^T P * B\right)^{-1} B^T P * AA \tag{2.10}$$

where P* is the unique positive definite solution to the algebraic Riccati equation (ARE)

$$P = Q + AA^T PAA - AA^T PB(R + B^T PB)^{-1} B^T PAA \tag{2.11}$$

Finite-Horizon LQR Controller 15180

In another embodiment, we propose to use the following finite-horizon LQR controller 15180 for a warm start control of the RL algorithm 16088. The finite N-horizon version of the LQR problem is also described by the system dynamics (2.8), but with the objective function summing up only up to time t=N; for example N can be set to hours if we want a long horizon control of the system or to minutes if we want to control the system of a short time horizon. We can parametrize the finite-horizon LQR problem as $\min_{\{K_t\}} J\{K_t\}$, where $$\mathcal{J}((K_t)) := \mathbb{E}_{x_0 \sim \mathcal{D}}\left[\sum_{t=0}^{N-1} x_t^T (Q + K_t^T R K_t) x_t + x_N^T Q_N x_N\right] \tag{2.12}$$

and $Q_N$ is a symmetric pd terminal-state weighting to be chosen. The unique optimal control policy in the finite-horizon LQR is time-varying and can be computed by $$K_t^* = (R + B^T P_{t+1}^* B)^{-1} B^T P_{t+1}^* AA \tag{2.13}$$

where $P^*_t$ for all $t \in \{0, \ldots, N-1\}$, are generated by the Riccati difference equation (RDE) starting with $P_{N*}=Q_N$:

$$P_t^* = Q + AA^T P_{t+1}^* AA - AA^T P_{t+1}^* B(R + B^T P_{t+1}^* B)^{-1} B^T P_{t+1}^* AA \tag{2.14}$$

Policy Gradient (PG) RL Controller 16188

LQR with Dynamic Programming

It is well known that the solution of the RDE (2.14) converges monotonically to the stabilizing solution of the ARE (2.11) exponentially. It then readily follows that the sequence of time-varying LQR policies (2.13), denoted as $\{K_t\}_{t \in \{N-1, \ldots, 0\}}$, converges monotonically to the time-invariant LQR policy K* as $N \to \infty$. Furthermore, if $Q_N$ satisfies $Q_N > P^*$, then the time-varying LQR policies are stabilizing when treated as frozen. Now, we formally present this convergence result in the following theorem.

Algorithm Design

We propose the RHPG (Receding Horizon Policy Gradient) algorithm FIG. 17C, which first selects N and then sequentially decomposes the finite-N-horizon LQR problem backward in time. Note that in practical implementations, N represents the parameters that the user can set to tune the time scale of policy learning, example, minutes or hours, depending on the application. For example, if the system optimal performance is critical, e.g., hospital operating rooms HVAC system, then we can set the tuning of the policy to be accelerated over a time scale of minutes. On the other hand, if the optimality of the system is not critical, e.g., wear-house environment, then the tuning of the policy can be set to be on a slower scale of hours.

In particular, for every iteration indexed by $h \in \{N-1, \ldots, 0\}$, the RHPG algorithm solves an LQR problem from t=h to t=N, where we only optimize for the current policy $K_h$ and fix all the policies $\{K_t\}$ for $t \in \{h+1, \ldots, N-1\}$ to be the convergent solutions generated from earlier iterations. Concretely, for every h, the RHPG algorithm solves the following quadratic program in $K_h$:

$$\min_{K_h} \mathcal{J}_h(K_h) := \mathbb{E}_{x_h \sim \mathcal{D}}\left[\sum_{t=h+1}^{N-1} x_t^T (Q + (K_t^*)^T R K_t^*) x_t + x_h^T (Q + K_h^T R K_h) x_h + x_N^T Q_N x_N\right]. \tag{3.1}$$

Due to the quadratic optimization landscape of (3.1) in Kh for every h, applying any PG method with an arbitrary finite initial point (e.g., zero) would lead to convergence to the globally optimal solution of (3.1).

PG Update

We analyze here the sample complexity of the zeroth-order PG update in solving each iteration of the RHPG algorithm FIG. 17C. Specifically, the zeroth-order PG update 17420 is defined as $$K_{h,i+1} = K_{h,i} - \eta_h \cdot \nabla J_h(K_{h,i}) \tag{3.2}$$

where $\eta_h > 0$ is the step-size to be determined and $\nabla J_h(K_{h,i})$ is the estimated PG sampled from a (two-point) zeroth-order oracle.

Model-Based LQ Tracking Control

We formulate the LQ tracking problem on the reduced-order system model (2.5) with the additive term $w_t$ ignored. The objective function 17023 is defined as $$\mathcal{J}_R := \limsup_{N \to \infty} \frac{1}{N}\left\{\sum_{t=0}^{N-1} \left((x_t - x_r)^T \overline{Q}(x_t - x_r) + u_t R u_t\right)\right\} \tag{3.3}$$

$$\text{s.t. } x_r = U^H z_r,\ \tilde{Q} := U^H Q U \geq 0,\ x_{t+1} = AAx_t + Bu_t,$$

$$u_t = \varphi(x_0, \ldots, x_t, u_0, \ldots, u_{t-1}).$$

For the reduced-order LQ tracking problem in (3.3), the optimal tracking controller has the form of:

$$u_t = B^T PAAx_t + (R + B^T PB)^{-1} B^T q_{t+1} \tag{3.4}$$

$$q_t = (AA - BK)^T q_{t+1} + Qx_r \quad q_\infty = Qx_r \tag{3.5}$$

where P is the solution of the algebraic Riccati equation $$P = AA^T PAA - AA^T PB(R + B^T PB)^{-1} B^T PAA + Q$$

Moreover, the closed-loop matrix $AA - B(R + B^T P B)^{-1} B^T P AA$ has a spectral radius less than 1. We can rewrite the optimal LQ tracking controller (3.4) equivalently as $$u_t = -K_a^* x_t + K_b^* x_r \tag{3.6}$$

where $K_{h*} = [K_{a*}, K_{b*}]$, and $K_{a*}$, $K_{b*}$ are the optimal tracking policies independent of the state $x_t$ and the command signal $x_r$ $$K_a^* = (R + B^T P B)^{-1} B^T P AA, \tag{3.7}$$

$$K_b^* = (R + B^T P B)^{-1} B^T (I - (AA - BK_a^*)^T)^{-1} Q \tag{3.8}$$

Policy Optimization with Warm Start

Naturally, we can apply the tracking controller (3.6) to the nonlinear system dynamics by projecting $z_t$ onto the reduced-order space and using the reduced order states as the feedback information. This results in the certainty-equivalent controller of the form 17320

$$u_t = -K_a^*(U^H z_t) + K_b^*(U^H z_r). \tag{3.9}$$

When the DMDc model is accurate, i.e., the term $w_t$ in (2.5) is sufficiently small to be negligible, then the certainty-equivalent controller (3.9) is a good candidate for the nonlinear control problem (2.3) and it balances performance and computationally efficiency.

However, when we is large, e.g., in nonlinear systems that exhibit chaotic behaviors, the performance of (3.9) could degrade substantially. Specifically, in these cases, the optimal certainty-equivalent tracking control policies $K_{a*}$ and $K_{b*}$ in (3.7), (3.8) could be far from the optimal policies within the same classes of parametrization. This modeling gap motivates us to iteratively fine-tune the tracking control policies using trajectories of the nonlinear dynamics (2.2) until reaching a (local) minima of (2.3), where the model-based tracking control policies $K_{a*}$ and $K_{b*}$ could serve as a warm start for the policy search procedure. Concretely, with a slight abuse of notations, we define the policy optimization problem to be $$\min_{K_a, K_b} J_R(K_a, K_b) \tag{3.10}$$

$$\text{s.t. } z_{t+1} = f_v(z_t, u_t),\ u_t = -K_a^*(U^H z_t) + K_b^*(U^H z_r). \quad \text{a}$$

where J follows the definition in (2.3), and $K_{h^*\,*}=[K_{a*}, K_{b*}]$, is learned using the RHPG RL algorithm 1, FIG. 17C.

In algorithm 1, FIG. 17C, the choice of the exploration radius rh, is selected based on its relationship with the number of iterations needed to converge to a neighborhood of the optimal gain values. For instance, if we select the radius of exploration $r_h$ to be proportional to ε, and the stepsize of the gradient descent $\eta_h$ to be proportional to $\varepsilon^2$, then we fix the maximum number of iterations $T_h$ needed to converge to the optimal values of the gains to $$\frac{1}{\varepsilon^2}\log\frac{1}{\varepsilon^2}.$$

Robustification of the RL Algorithm FIG. 17B

We finally, show on this Burger's PDE example, how one could implement the robust RL FIG. 17B. For instance, in this example, the uncertain parameter p could be considered to be the viscosity parameter ν. In this case, one can sample n values of ν: $\nu_1, \ldots, \nu_n$ 17200. Next, we solve for the optimal control problem (3.10) for each $\nu_i$, i=1, . . . , n, and collect a set of optimal gains $K_h^i$, i=1, . . . , n, 17320, 17322. Finally, we average these gains to obtain the robust optimal feedback gain $$K_h^* = \text{average}(K_h^i),\ i = 1, \ldots, n\ 17520.$$

The above description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Although the present disclosure describes the invention by way of examples of preferred embodiments, it is understood that various other adaptations and modifications may be made within the spirit and scope of the invention. Therefore, it is the object of the appended claims to cover all such variations and modifications as come within the true spirit and scope of the invention.

We claim:

1. An optimization controller for controlling an operation of a heating, ventilation and air conditioning (HVAC) system for air-conditioning a room, comprising:

an input interface configured to receive setpoint values, and system measurements and airflow measurements respectively from system sensors arranged in the HVAC system and airflow sensors arranged in the room;

a memory configured to store one or more programs including instructions for a reinforcement learning (RL) policy gradient algorithm, a high dimensional (HD) physics-based model of airflow dynamics for the HVAC system, and reference signals $z_r$;

a processor configured to perform the instructions comprising:

determining a horizon value N based on the setpoints and n parameter values $p_i$ i=1, . . . , n, of the HD physics-based model based on the system measurements;

computing state trajectories $z_i$ corresponding to the parameter values $p_i$;

providing a set of RL controllers $u_i$ represented by first and second gains $k_a^i$, $k_b^i$, the state trajectories $z_i$, and the reference signals $z_r$;

performing warm-start of the RL policy gradient algorithm using the RL controllers with warm-start initial gains $K_{i,0}$;

computing feedback gains $$k_a^i, k_b^i,$$

for the set of RL controllers $u_i$ according to the RL policy gradient algorithm;

determining optimal feedback gains K* by averaging the feedback gains $$k_a^i, k_b^i,$$

generating a control command based on the optimal feedback gains K*; and an output interface configured to transmit the control command to a supervisory controller connected to a set of control devices of the HVAC system to control the operation of the of the HVAC system.

2. The optimization controller of claim 1, wherein the supervisory controller is integrated therein.

3. The controller of claim 1, wherein at least one of the airflow sensors measures a velocity of an airflow at a predetermined point in the room.

4. The optimization controller of claim 1, wherein the warm-start initial gains $K_{i,0}$ are computed based on a dynamic mode decomposition reduced order model of the HD physics-based model.

5. The optimization controller of claim 4, wherein the warm-start initial gains $K_{i,0}$ are computed based on a linear quadratic controller for the reduced order model.

6. The optimization controller of claim 1, wherein the warm-start initial gains $K_{i,0}$ are computed based on a proper orthogonal decomposition reduced order model of the HD physics-based model.

7. The optimization controller of claim 6, wherein the warm-start initial gains $K_{i,0}$ are computed based on a linear quadratic controller for the reduced order model.

8. The optimization controller of claim 1, wherein the warm-start initial gains $K_{i,0}$ are computed based on a robust reduced order model of the HD physics-based model.

9. The optimization controller of claim 8, wherein the robust reduced order model is computed based on a robust closure model of the HD physics-based model.

10. The optimization controller of claim 8, wherein the warm-start initial gains $K_{i,0}$ are computed based on a robust controller for the robust reduced order model.

11. The optimization controller of claim 10, wherein the robust controller is computed based on H-infinity control.

12. The optimization controller of claim 10, wherein the robust controller is computed based on linear quadratic Gaussian (LQG) control.

13. A non-transitory computer-readable medium having stored thereon a set of instructions for controlling an electric motor, which if performed by one or more processors, cause the one or more processors to at least:

determine a horizon value based on the setpoints and n parameter values of a high dimensional (HD) physics-based model based on the system measurements;

compute state trajectories corresponding to the parameter values;

provide a set of RL controllers represented by first and second gains, the state trajectories, and the reference signals;

perform warm-start of the RL policy gradient algorithm using the RL controllers with an initial gain;

compute feedback gains, for the set of RL controllers, according to the RL policy gradient algorithm;

determine optimal feedback gains by averaging the feedback gains;

generate a control command based on the optimal feedback gains; and transmit the control command to a supervisory controller connected to a set of control devices of the HVAC system to control the operation of the of the HVAC system.

14. The non-transitory computer-readable medium of claim 13, wherein the supervisory controller is integrated therein.

15. The non-transitory computer-readable medium of claim 13, wherein at least one of the airflow sensors measures a velocity of an airflow at a predetermined point in the room.

16. The non-transitory computer-readable medium of claim 13, wherein the warm-start initial gain is computed based on a dynamic mode decomposition reduced order model of the HD physics-based model.

17. The non-transitory computer-readable medium of claim 13, wherein the warm-start initial gain is computed based on a proper orthogonal decomposition reduced order model of the HD physics-based model.

18. The non-transitory computer-readable medium of claim 13, wherein the warm-start initial gain is computed based on a robust reduced order model of the HD physics-based model.

* * * * *